US012404622B2

(12) United States Patent
Kim

(10) Patent No.: US 12,404,622 B2
(45) Date of Patent: Sep. 2, 2025

(54) CLOTHES TREATING APPARATUS

(71) Applicant: SAMSUNG ELECTRONICS CO., LTD., Suwon-si (KR)

(72) Inventor: Junho Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 372 days.

(21) Appl. No.: 17/992,497

(22) Filed: Nov. 22, 2022

(65) Prior Publication Data

US 2023/0212808 A1 Jul. 6, 2023

Related U.S. Application Data

(63) Continuation of application No. PCT/KR2022/014577, filed on Sep. 28, 2022.

(30) Foreign Application Priority Data

Jan. 3, 2022 (KR) ..... 10-2022-0000244

(51) Int. Cl.
*D06F 39/08* (2006.01)
*D06F 39/02* (2006.01)
(Continued)

(52) U.S. Cl.
CPC ..... *D06F 39/085* (2013.01); *D06F 39/022* (2013.01); *D06F 39/087* (2013.01);
(Continued)

(58) Field of Classification Search
CPC .... D06F 39/085; D06F 39/022; D06F 39/087; D06F 39/088; D06F 39/06; D06F 39/10; D06F 2105/06; D06F 2105/42
See application file for complete search history.

(56) References Cited

U.S. PATENT DOCUMENTS 9,487,904 B2 11/2016 Kim et al.
9,885,137 B2 2/2018 Kim et al.
(Continued)

FOREIGN PATENT DOCUMENTS

EP 2719816 B1 6/2021
JP 7-68082 3/1995
(Continued)

OTHER PUBLICATIONS

International Search Report dated Jan. 25, 2023 issue in PCT Application No. PCT/KR2022/014577.
(Continued)

*Primary Examiner* — Joseph L. Perrin
(74) *Attorney, Agent, or Firm* — STAAS & HALSEY LLP

(57) ABSTRACT

A clothes treating apparatus including: a cabinet; a tub provided in the cabinet and configured to collect wash water; a circulation device configured to circulate the wash water contained in the tub and including a circulation pump, a first circulation path to guide the wash water from the tub to the circulation pump, and a second circulation path to guide the wash water from the circulation pump to the tub so that the wash water circulates by flowing from the tub to the circulation pump through the first circulation path and flowing back to the tub from the circulation pump through the second circulation pat; and a detergent supply device configured to supply a detergent to the circulation device and including a detergent case, and a detergent pump connected to the detergent case and mounted on the first circulation path to supply the stored detergent through the first circulation path.

20 Claims, 14 Drawing Sheets

(51) Int. Cl.

| | |
|---|---|
| *D06F 39/06* | (2006.01) |
| *D06F 39/10* | (2006.01) |
| *D06F 105/06* | (2020.01) |
| *D06F 105/08* | (2020.01) |
| *D06F 105/42* | (2020.01) |

(52) U.S. Cl.
CPC ..... *D06F 39/088* (2013.01); *D06F 39/06* (2013.01); *D06F 39/10* (2013.01); *D06F 2105/06* (2020.02); *D06F 2105/08* (2020.02); *D06F 2105/42* (2020.02)

(56) References Cited

U.S. PATENT DOCUMENTS

| | | | | |
|---|---|---|---|---|
| 10,145,052 | B2 | 12/2018 | Kim et al. | |
| 10,415,173 | B2 | 9/2019 | Seo et al. | |
| 10,619,288 | B2 * | 4/2020 | Kim | D06F 58/206 |
| 10,711,385 | B2 | 7/2020 | Kim et al. | |
| 11,299,837 | B2 | 4/2022 | Cho et al. | |
| 2010/0115709 | A1 * | 5/2010 | Kim | D06F 39/022 68/17 R |
| 2014/0096572 | A1 * | 4/2014 | Kim | D06F 39/12 68/17 R |
| 2014/0109323 | A1 * | 4/2014 | Kim | D06F 39/086 68/17 R |
| 2016/0010267 | A1 * | 1/2016 | Kim | D06F 39/022 8/137 |
| 2016/0186370 | A1 * | 6/2016 | Kim | D06F 39/02 68/17 R |
| 2018/0127912 | A1 | 5/2018 | Leibman | |
| 2018/0171529 | A1 | 6/2018 | Xu et al. | |
| 2019/0100864 | A1 | 4/2019 | Cho et al. | |
| 2021/0212339 | A1 | 7/2021 | Soffientini et al. | |

FOREIGN PATENT DOCUMENTS

| | | |
|---|---|---|
| KR | 1995-0012727 | 10/1995 |
| KR | 10-0421883 | 3/2004 |
| KR | 10-0624367 | 9/2006 |
| KR | 10-0730939 | 6/2007 |
| KR | 10-0781247 | 11/2007 |
| KR | 10-0781248 | 11/2007 |
| KR | 10-2008-0089086 | 10/2008 |
| KR | 10-2013-0010801 | 1/2013 |
| KR | 10-1444356 | 9/2014 |
| KR | 10-2015-0103988 | 9/2015 |
| KR | 10-2015-0125342 | 11/2015 |
| KR | 10-2018-0010225 | 1/2018 |
| KR | 10-2021-0060386 | 5/2021 |
| KR | 10-2255022 | 5/2021 |
| KR | 10-0830488 | 5/2022 |
| WO | WO 2008120935 A1 | 10/2008 |

OTHER PUBLICATIONS

Written Opinion dated Jan. 25, 2023 issue in PCT Application No. PCT/KR2022/014577.

European Search Report dated Nov. 15, 2024 issued European Application EP 22 91 6307.

* cited by examiner

CLOTHES TREATING APPARATUS

CROSS-REFERENCE TO RELATED APPLICATION

This application is a continuation application, filed under 35 U.S.C. § 111(a), of International Application PCT/KR2022/014577 filed Sep. 28, 2022, and is based on and claims priority under 35 U.S.C. § 119 to Korean Patent Application No. 10-2022-0000244, filed on Jan. 3, 2022 in the Korean Intellectual Property Office, the disclosure of which is incorporated by reference herein in its entirety.

BACKGROUND

1. Field

The present disclosure relates to a clothes treating apparatus, and more particularly, to a clothes treating apparatus including a detergent supply device.

2. Description of the Related Art

In general, a clothes treating apparatus includes a washing machine configured to wash laundry loaded in a rotary tub by mutual friction by rotating the laundry and a detergent together using a driving force of a motor, a dryer configured to dry an object to be dried and contained in the rotary tub by rotating the rotary tub, and the like.

A clothes treating apparatus may include a detergent supply device provided in a cabinet, and the detergent supply device is a device configured to supply a detergent into a tub. The detergent supply device may include a detergent case, and a detergent pump configured to supply the detergent contained in the detergent case into the tub in response to docking with the detergent case.

In this case, the detergent discharged from the detergent pump should be mixed with wash water and the detergent may remain in a flow path from the detergent pump to a space in which the detergent is to be mixed with wash water. In the case where the detergent residues are left, contamination and solidification of the detergent may occur.

SUMMARY

In accordance with an aspect of the present disclosure, a clothes treating apparatus includes: a cabinet; a tub provided in the cabinet and configured to collect wash water; a circulation device configured to circulate the wash water contained in the tub, and the circulation device including a circulation pump, a first circulation path provided to guide wash water from the tub to the circulation pump, and a second circulation path provided to guide wash water from the circulation pump to the tub so that the wash water circulates by flowing from the tub to the circulation pump through the first circulation path and flowing back to the tub from the circulation pump through the second circulation path; and a detergent supply device configured to supply a detergent to the circulation device, and the detergent supply device including a detergent case, and a detergent pump connected to the detergent case to store the detergent and mounted on the first circulation path to supply the stored detergent through the first circulation path.

The first circulation path may include: a drain path to guide the wash water discharged from the tub out of the tub; and a mixing path to guide the wash water to the circulation pump flowing from the drain path and mounted with the detergent pump.

The drain path may include: a first drain path to guide the wash water from the tub out of the tub; and a second drain path connected to the first drain path and branching from the first drain path.

The clothes treating may further include a drain pump configured to receive the wash water from the first drain path and mounted on the second drain path.

The clothes treating apparatus may further include a water supply device configured to supply the wash water into the tub from an external water supply source, wherein the wash water flowing into the tub by the water supply device flows to the tub after passing through the first circulation path, the circulation pump and the second circulation path in response to the circulating of the wash water by the circulation pump.

The clothes treating apparatus may further include a processor configured to selectively operate the circulation pump or the drain pump.

The processor may be further configured to operate the circulation pump in response to determining that a water level in the tub reaches a predetermined water level.

The processor may be further configured to operate the detergent pump in response to the operating of the circulation pump.

The detergent case may include: a first detergent case; and a second detergent case separated from the first detergent case in a lateral direction, wherein the processor is further configured to operate the circulation pump based on initiation of a washing mode, the detergent pump to allow a detergent contained in the first detergent case to flow into the detergent pump based on the operation of the circulation pump, and the detergent pump to allow a detergent contained in the second detergent case to flow into the detergent pump based on initiation of a rinsing mode.

The processor may be further configured to turn off the circulation pump and turn on the drain pump to drain the wash water contained in the tub.

The detergent supply device and the circulation device may be disposed below the tub.

The detergent supply device may be a first detergent supply device, and the clothes treating apparatus may further include a second detergent supply device disposed above the tub to supply the detergent into the tub.

The clothes treating apparatus may further include: a fan above the tub to form a circulating air flow passing through the tub; and a heat exchanger above the tub to dehumidify and heat air discharged from the tub and supply the dehumidified and heated air to the tub.

The detergent supply device may further include a drawer configured to accommodate the detergent case and to be withdrawn from or inserted into the cabinet.

The drawer may include: a first drawer configured to accommodate the detergent case and withdrawn from or inserted into the cabinet; and a second drawer coupled to a side wall of the cabinet, configured to accommodate the first drawer, and slidably coupled to the first drawer allowing the first drawer to slide.

A clothes treating apparatus according to an embodiment of the present disclosure may include a cabinet, a tub in the cabinet, a water supply device configured to supply wash water into the tub from an external water source, and a detergent supply device configured to supply a detergent into the tub, disposed at a lower portion of the cabinet, the detergent supply device comprising a detergent case, a detergent pump including an inlet through which the detergent is introduced from the detergent case and an outlet through which the introduced detergent is to discharge the detergent, and a mixing space formed therein to receive wash water from the tub and directly connected to the outlet of the detergent pump to receive the discharged detergent from the detergent pump.

The supplied wash water from the external water supply source may flow back to the tub after passing through the water supply device, the tub, and the mixing space.

A clothes treating apparatus according to an embodiment of the present disclosure may include a cabinet, a tub in the cabinet and configured to collect wash water, a detergent supply device configured to supply a detergent into the tub, the detergent supply device including a detergent case to accommodate the detergent, a detergent pump including an inlet through which the detergent is introduced from the detergent case and an outlet through which the introduced detergent is discharged to discharge the detergent, and a mixing space formed therein to receive wash water from the tub and directly connected to the outlet of the detergent pump to receive the detergent from the detergent pump, a drain pump connected to the tub to drain the wash water contained in the tub out of the cabinet, a circulation pump connected to the tub to circulate the wash water, and a processor configured to selectively operate the drain pump or the circulation pump.

The processor may be further configured to operate the detergent pump in response to the operating of the circulation pump.

The processor may be further configured to turn off the circulation pump and turn on the drain pump to drain the wash water contained in the tub.

DETAILED DESCRIPTION

Figure 1:
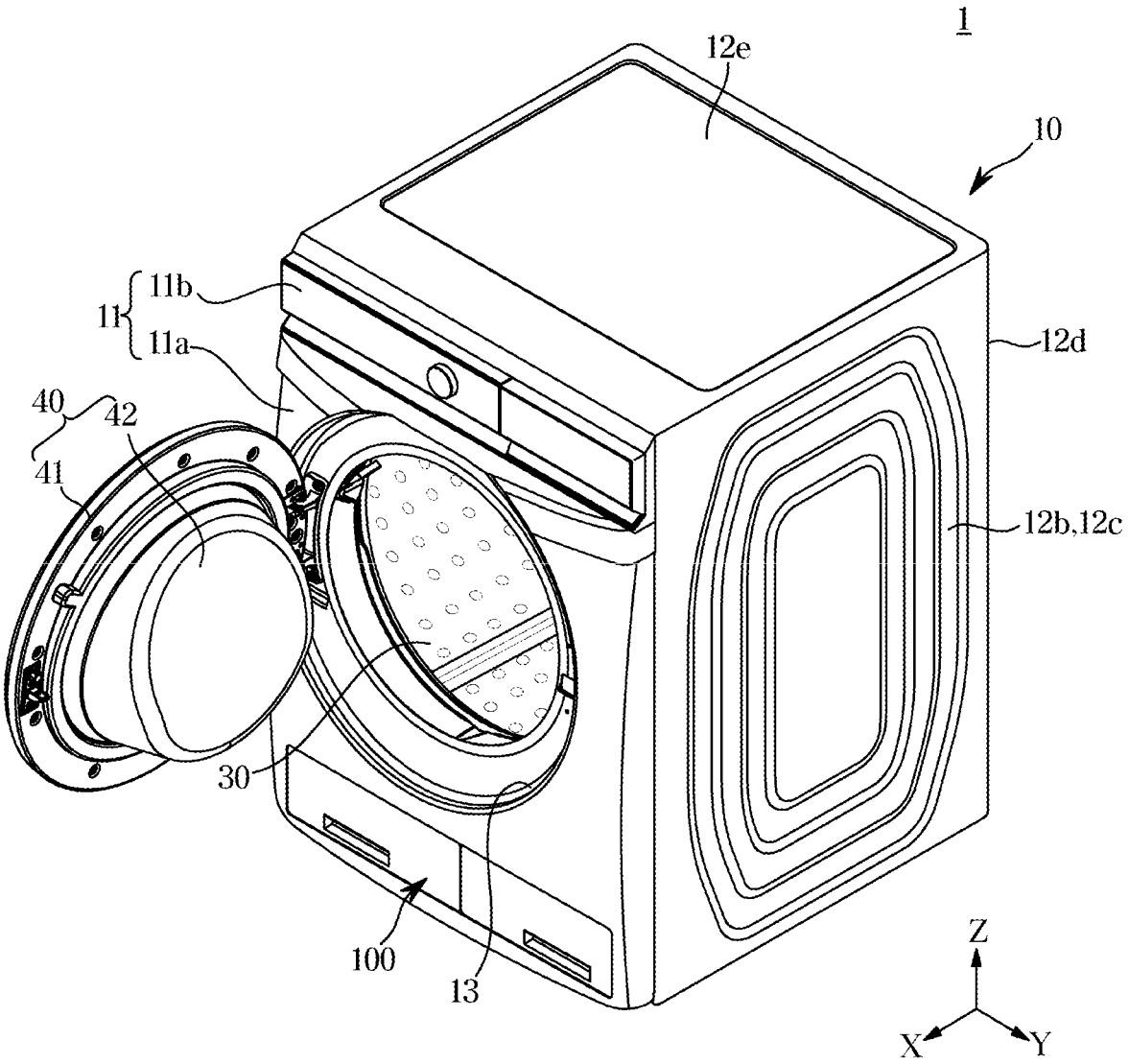
FIG. 1 is a perspective view of a clothes treating apparatus according to an embodiment of the present disclosure.

Reference will now be made in detail to the embodiments of the present disclosure, examples of which are illustrated in the accompanying drawings. The embodiments described in the specification and shown in the drawings are only illustrative and are not intended to represent all aspects of the invention, such that various modifications may be made without departing from the spirit of the invention.

In the drawings, like reference numerals denote like elements or components having substantially same functions.

Throughout the specification, the terms used are merely used to describe particular embodiments, and are not intended to limit the present disclosure. As used herein, the singular forms are intended to include the plural forms as well, unless otherwise stated. Also, it is to be understood that the terms such as "include", "have", or the like, are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

The terms used throughout the specification "front", "rear", "left", and "right", and the like are defined based on the drawings and the shape and position of each element are not limited by these terms. A clothes treating apparatus 1 according to various embodiments of the present disclosure may include washing machines, clothes dryers, clothes care apparatuses, and the like. However, for descriptive convenience, the embodiments of the present disclosure will be described below using a front-loading washing machine 1 as an example.

In addition, a detergent may include not only laundry detergents but also rinses, deodorizers, disinfectants, or fragrances for dryers.

A clothes treating apparatus may be capable of preventing detergent residues in a detergent supply device.

A clothes treating apparatus may be capable of reducing contamination and solidification of a detergent by preventing detergent residues.

A clothes treating apparatus may have improved user convenience.

According to an embodiment of the present disclosure, a clothes treating apparatus capable of preventing detergent residues by mounting a detergent pump on a circulation path may be provided.

According to an embodiment of the present disclosure, a clothes treating apparatus in which a detergent pump is directly connected to a circulation path may be provided.

According to an embodiment of the present disclosure, a clothes treating apparatus having improved user convenience by preventing malfunctioning caused by detergent residues in advance may be provided.

Hereinafter, the embodiments of the present disclosure will be described in detail with reference to the accompanying drawings.

Figure 2:
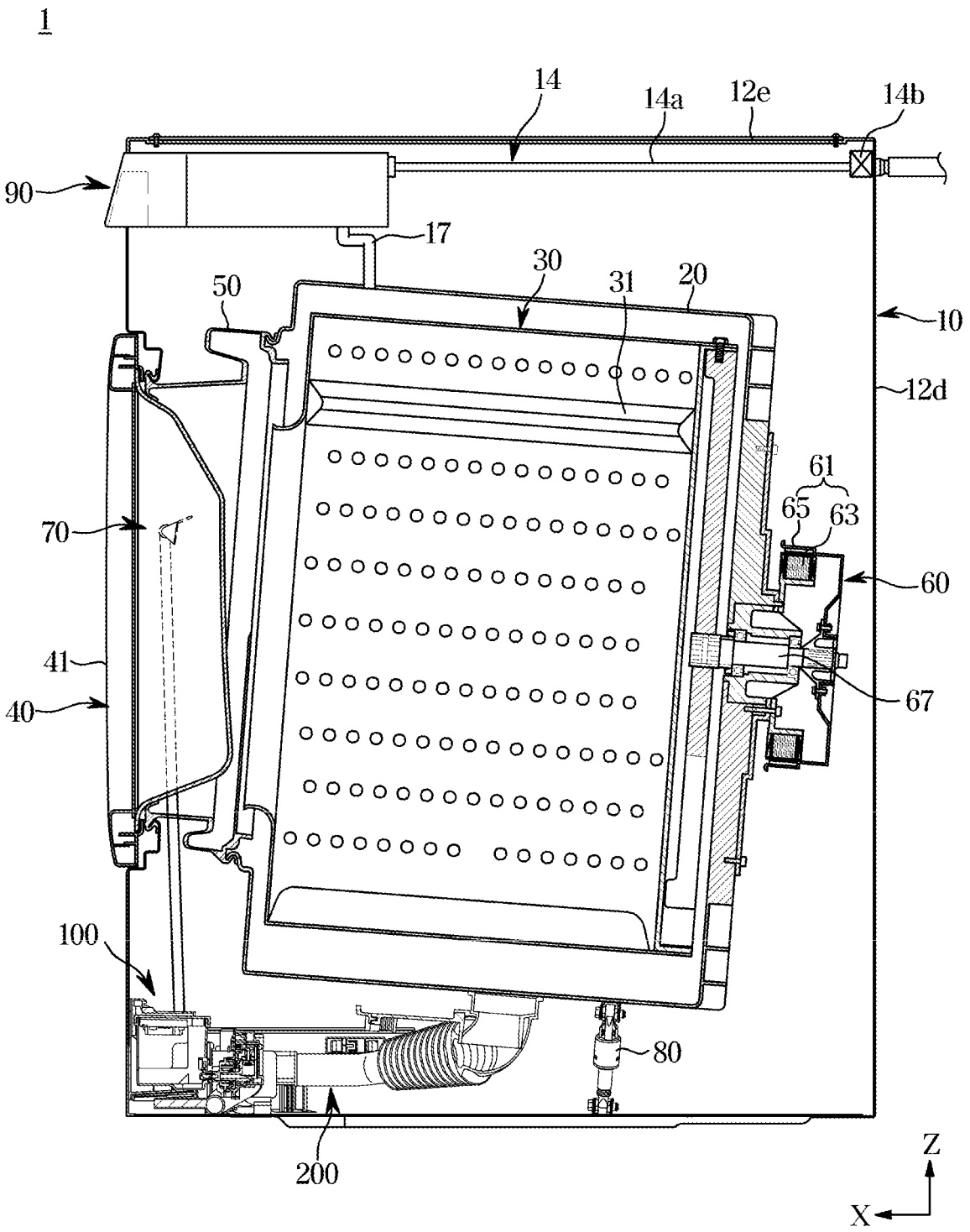
FIG. 2 is a side cross-sectional view of the clothes treating apparatus illustrated in FIG. 1.
Figure 3:
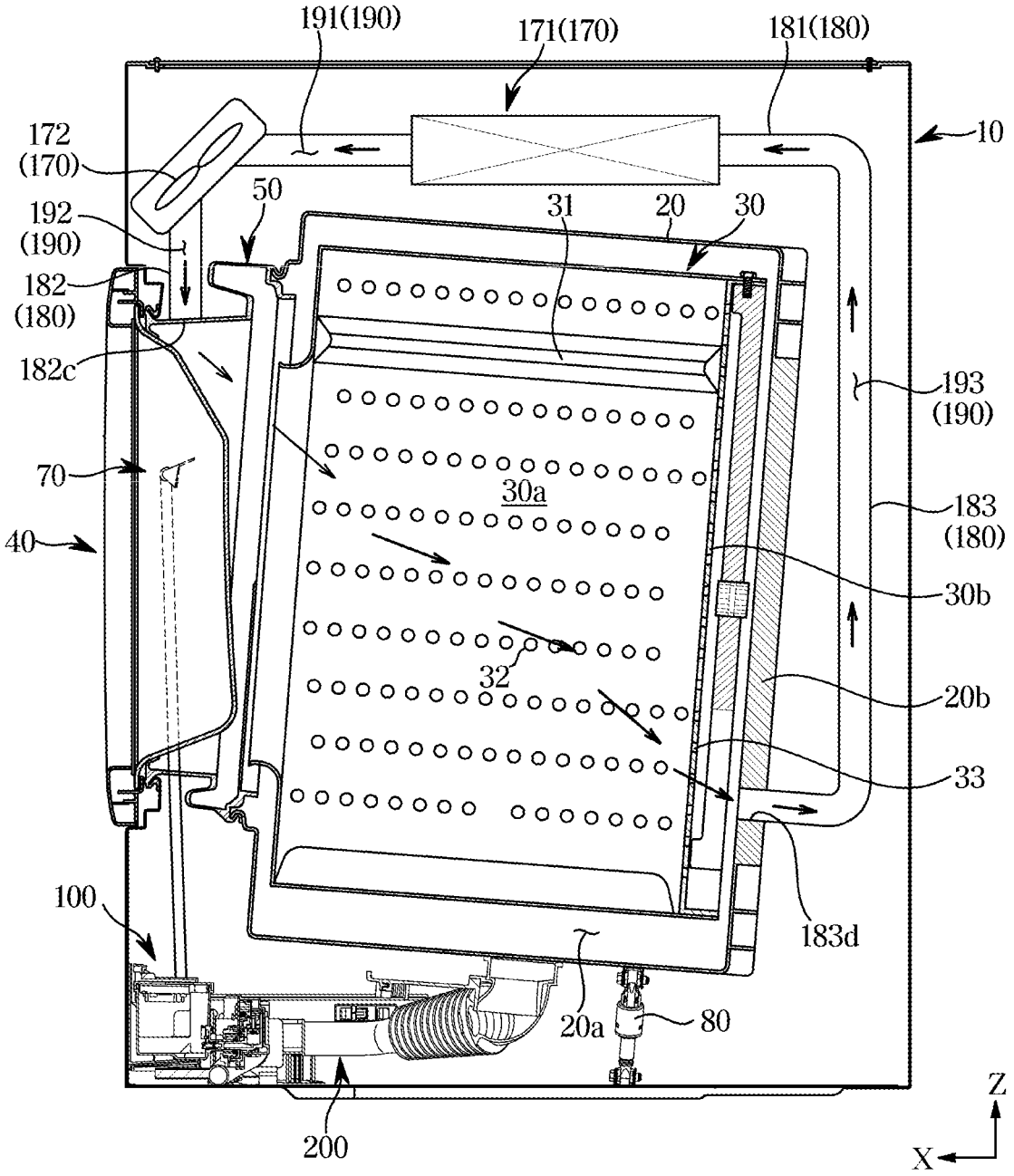
FIG. 3 is a side cross-sectional view of the clothes treating apparatus illustrated in FIG. 1.
Figure 4:
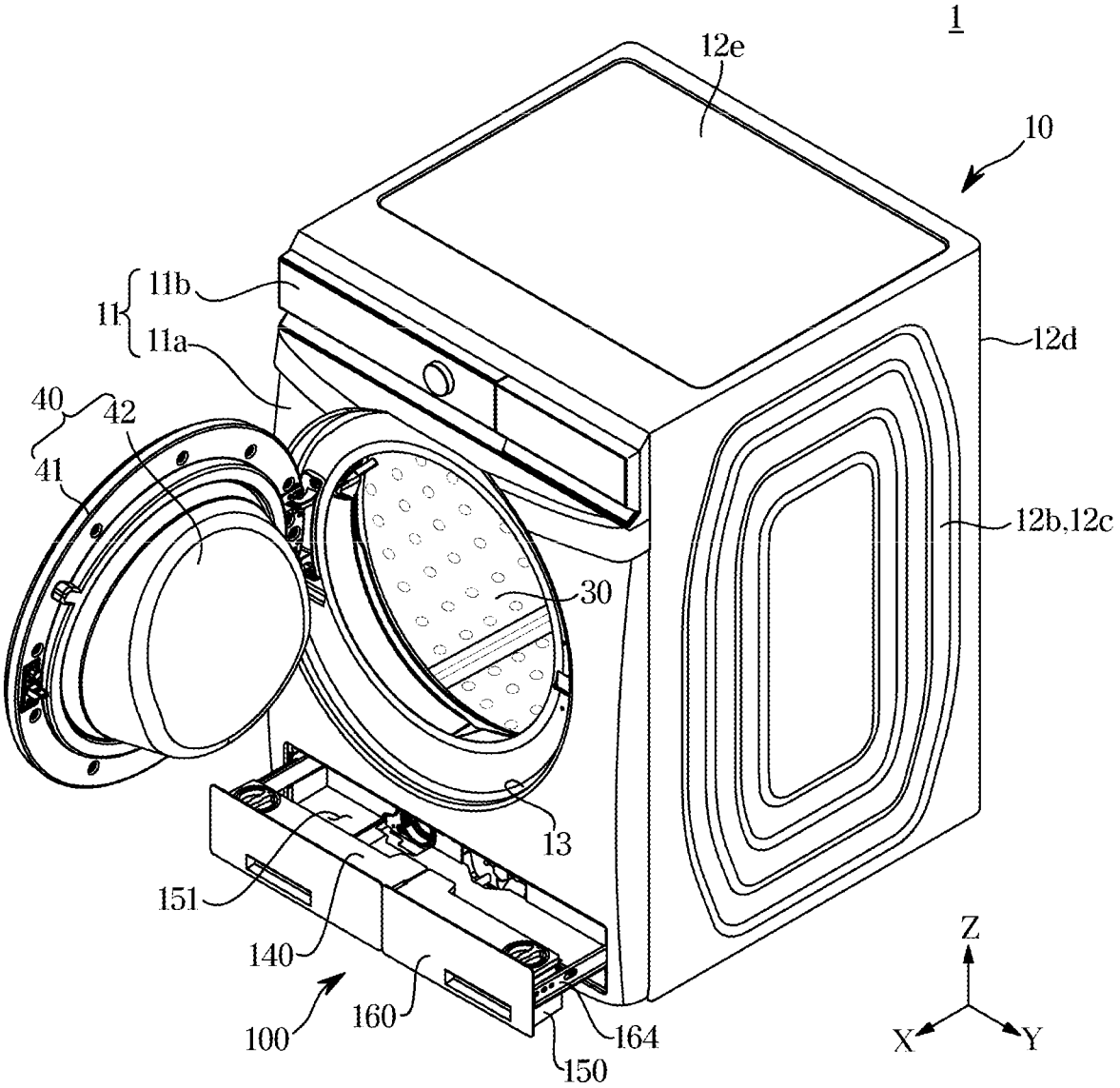
FIG. 4 is a perspective view showing a state where a detergent supply device is withdrawn from a cabinet in the clothes treating apparatus illustrated in FIG. 1.

FIG. 1 is a perspective view of a clothes treating apparatus according to an embodiment of the present disclosure. FIG. 2 is a side cross-sectional view of the clothes treating apparatus illustrated in FIG. 1. FIG. 3 is a side cross-sectional view of the clothes treating apparatus illustrated in FIG. 1. FIG. 4 is a perspective view showing a state where a detergent supply device is withdrawn from a cabinet in the clothes treating apparatus illustrated in FIG. 1.

Referring to FIGS. 1 to 4, a washing machine 1 includes a cabinet 10 defining an exterior appearance of the washing machine 1 and accommodating various components, a tub 20 provided in the cabinet 10 to contain mixed water in which wash water and a detergent are mixed, a drum 30 provided in the tub 20 to contain laundry and configured to rotate, and a drive device 60 configured to rotate the drum 30. The drive device 60 is located behind the tub 20 and configured to rotate the drum 30 in the forward-reverse directions to perform washing, rinsing, spin-drying, and drying operations.

The cabinet 10 may be formed in a substantially hexahedral shape. The cabinet 10 may be formed in a box shape with an open front. The cabinet 10 may include a rear plate 12*d* and both side plates 12*b* and 12*c* located at both sides of the rear plate 12*d* in the forward direction. Although the cabinet 10 including the rear plate 12*d* and the side plates 12*b* and 12*c* which are integrated with each other is shown herein by way of example, the present disclosure is not limited thereto. The cabinet 10 may include a front panel 11 provided in the open front, a base 19 provided at the bottom, and a top cover 12*e* provided at the upper surface.

The front panel 11 may include a first front panel 11*a* and a second front panel 11*b* located at an upper side of the first front panel 11*a*.

The first front panel 11*a* may be provided in front of the drum 30. The first front panel 11*a* may be located at a lower side of the second front panel 11*b*. The first front panel 11*a* may have an opening 13 through which laundry is loaded into the drum 30. The opening 13 of the first front panel 11*a* is formed to allow the laundry to be loaded or unloaded in the forward direction of the cabinet 10. The opening 13 of the first front panel 11*a* may be open or closed by a door 40. The door 40 may include a door frame 41 and a door glass 42. The door glass 42 may be formed of a transparent tempered glass material such that the interior of the cabinet 10 is visible therethrough.

The second front panel 11*b* may be provided at an upper-front side of the cabinet 10. The second front panel 11*b* may be disposed on the upper side of the first front panel 11*a*. The upper end of the second front panel 11*b* is provided to be coupled to the top cover 12*e*.

The second front panel 11*b* may include a control panel (not shown) including an inputter configured to receive an operation command from a user and a display (not shown) configured to display operation information of the washing machine 1.

The base 19 may be configured to cover the bottom of the cabinet 10.

A water supply device 14 may be provided above the tub 20. The water supply device 14 may include a water supply valve 14*b* configured to control water supply and water supply pipes 14*a*. The water supply device 14 may supply water into the tub 20. For example, water flowing into the cabinet 10 through the water supply device 14 may be collected in the cabinet 10.

The clothes treating apparatus according to an embodiment of the present disclosure may include detergent supply devices 90 and 100. The detergent supply devices 90 and 100 may supply detergents into the tub 20. The detergent supply devices 90 and 100 may be provided in plural. The plurality of detergent supply devices 90 and 100 may include a first detergent supply device 100 and a second detergent supply device 90.

The first detergent supply device 100 may be disposed below the tub 20. For example, the first detergent supply device 100 may be disposed at a lower portion in the cabinet 10. The first detergent supply device 100 may be disposed at the bottom in the cabinet 10. The first detergent supply device 100 may be withdrawn from the cabinet 10 or inserted into the cabinet 10 at a lower portion of the front panel. The first detergent supply device 100 may be slidably moved (See FIG. 4).

The first detergent supply device 100 may allow the detergent to flow into the tub 20. For example, the first detergent supply device 100 may allow a liquid laundry detergent and/or a fabric softener to flow into the tub 20. However, types of the detergent are not limited thereto.

The second detergent supply device 90 may be disposed above the tub 20. For example, the second detergent supply device 90 may be disposed at an upper portion in the cabinet 10. The second detergent supply device 90 may be disposed at the top in the cabinet 10. The second detergent supply device 90 may be installed in the second front panel 11*b*. The second detergent supply device 90 may be withdrawn from the cabinet 10 or inserted into the cabinet 10 at an upper portion of the front panel 11. The second detergent supply device 90 may be slidably moved.

The second detergent supply device 90 may allow the detergent to flow into the tub 20. For example, the second detergent supply device 90 may allow a sold laundry detergent and/or fabric softener to flow into the tub 20. However, types of the detergent are not limited thereto.

The first detergent supply device 100 may be disposed below the tub 20 and supply the detergent into the tub 20 during a water supplying process, and the second detergent supply device 90 may be disposed above the tub 20 and supply the detergent into the tub 20 during the water supplying process.

In the clothes treating apparatus according to an embodiment of the present disclosure 1, water flowing into the washing machine 1 through the water supply device 14 may flow into the detergent supply devices 90 and 100. For example, the second detergent supply device 90 may be connected to the tub 20 via a supply pipe 17. Wash water supplied via the water supply pipe 14*a* may pass through the second detergent supply device 90 and be mixed with the detergent, and the mixed water in which the wash water is mixed with the detergent may be supplied into the tub 20.

The washing machine may further include a circulation device 200. The circulation device 200 may allow water contained in the tub 20 to circulate inside the washing machine 1. For example, the circulation device 200 may allow water to flow from the tub 20 into the first detergent supply device 100 and then to flow from the first detergent supply device 100 back into the tub 20.

The drive device 60 may be disposed behind the drum 30. The drive device 60, as a component to rotate the drum 30, may be configured to rotate the drum 30 by transmitting a driving force generated by a motor 61 to a rotary shaft 67.

The motor 61 including a fixed stator 63 and a rotor 65 configured to rotate via electromagnetic interaction with the stator 63 may convert electric power into mechanical rational power. However, the components of the motor 61 are not limited thereto.

The tub 20 stores the mixed water in which wash water is mixed with the detergent and may have a substantially cylindrical shape. The tub 20 may be fixed inside the cabinet 10. The opening 13 of the front panel 11 may be connected to the tub 20 by a diaphragm 50. The diaphragm 50 may seal a space between the front panel 11 and the tub 20.

A spray nozzle 70 connected to a circulation hose and configured to spray the circulating mixed water into the tub 20 and/or the drum 30 may be provided at one side of the diaphragm 50. The spray nozzle 70 may be provided to uniformly spray the mixed water into the entire laundry contained in the drum 30. The circulation hose may be connected to a circulation pump 210 configured to pump the contained mixed water from the bottom of the tub 20.

The drum 30 may perform a washing operation by lifting and dropping laundry while rotating in the tub 20. A plurality of lifters 31 may be provided inside the drum 30.

A drain device (not shown) configured to drain water contained in the tub 20 and including a drain pipe 241 (See FIG. 6) and a drain valve (not shown) may be installed below the tub 20.

The tub 20 may be provided to be elastically supported by the cabinet 10 via a spring (not shown) located at an upper portion of the tub 20 and dampers 80 provided at lower portions of the tub 20. That is, the spring and the dampers 80 absorb vibration energy between the tub 20 and the cabinet 10 while vibration generated during rotation of the drum 30 is transmitted to the tub 20 and the cabinet 10, thereby attenuating the vibration transmitted to the tub 20 and the cabinet 10.

The washing machine 1 may include a hot air supply device 170. The hot air supply device 170 may be disposed in the cabinet 10. The hot air supply device 140 may supply hot air to the tub 20 and/or the drum 30. The hot air supply device 170 may include a fan 172 and a heat exchanger 171.

The washing machine 1 according to an embodiment of the present disclosure may include a compressor (not shown), a heat exchanger 171, and an expansion device (not shown). The heat exchanger 171 may be located above the drum 30. The heat exchanger 171 may include a condenser (not shown) and an evaporator (not shown).

The washing machine may further include the fan 172. The fan 172 may blow air inside the drum interior 30*a* and air passing through the heat exchanger 171 in the air circulation path 190. The fan 172 may form an air flow such that air flows in the air circulation path 190. The fan 172 may be a centrifugal fan. However, types of the fan 172 are not limited thereto.

The heat exchanger 171 may be configured to dehumidify and heat air passing through the air circulation path 190. The heat exchanger 171 may dehumidify and heat air flowing into a tub interior 20*c*. Thereby, clothes contained in the drum interior 30*a* may be dried.

The washing machine may include a duct assembly 180. The duct assembly 180 may further include an upper duct 181, a front duct 182, and a rear duct 183.

The upper duct 181 may be located above the drum 30 and the tub 20 and guide air discharged from the drum 30 to flow back into the tub 20 after dehumidifying and heating the air. The heat exchanger 171 may be accommodated in the upper duct 181. The upper duct 181 may be referred to as an upper frame 181. A first air circulation path 191 may be provided in the upper duct 181.

The front duct 182 may be located in front of the drum 30 and the tub 20 and guide air flowing toward the drum 30. Air that has passed the heat exchanger 171 may be supplied into the drum 30 through the front duct 182. The front duct 182 may constitute a part of the air circulation path 190. The fan 172 may be accommodated in the front duct 182. A second air circulation path 192 may be provided in the front duct 182.

The rear duct 183 may be located behind the drum 30 and the tub 20 and guide air from the drum interior 30*a* to the heat exchanger 171. Air contained in the drum interior 30*a* may flow into the heat exchanger 171 through the rear duct 183. The rear duct 183 may constitute a part of the air circulation path 190. A third air circulation path 193 may be provided in the rear duct 183.

The front duct 182 and the rear duct 183 may guide air contained in the drum interior 30*a* to circulate through the air circulation path 190 in the cabinet 10. In addition, because air discharged from the front duct 182 may be introduced into the tub 20 and the drum 30 through the diaphragm 50, the diaphragm 50 may also circulate air inside the cabinet 10 through the air circulation path 190.

The washing machine may further include the air circulation path 190. The air circulation path 190 may include a first air circulation path 191, a second air circulation path 192, and a third air circulation path 193. The first air circulation path 191 may be formed by the upper duct 181, the second air circulation path 192 may be formed by the front duct 182, and the third air circulation path 193 may be formed by the rear duct 183. The first air circulation path 191, the second air circulation path 192, and the third air circulation path 193 are hot limited to the above-described example. For example, a flow path formed in the rear duct 183 may be the first air circulation path 191, a flow path formed in the upper duct 181 may be the second air circulation path 192, and a flow path formed in the front duct 182 may be formed in the third air circulation path 193.

Hereinafter, an air flow in the washing machine while the drying mode of the washing machine is performed will be described. After the washing and spin-drying modes of the washing machine are finished, a drying mode may be performed. A user may add the drying mode before the washing mode of the washing machine is initiated.

Air in the drum interior 30*a* may circulate in a closed circuit (in a direction of the arrow) inside the cabinet 10. In response to the operation of the fan 172, humid air in the drum interior 30*a* may flow into the tub 20 through spin-drying holes 32 formed in the circumferential inner wall of the drum 30 and/or through-holes 33 formed in a drum rear wall 30*b*. For example, air in the drum interior 30*a* may flow into a space 20*a* between the drum 30 and the tub 20. Air in the space 20*a* between the drum 30 and the tub 20 may flow into the air circulation path 190 through communicating holes 183*c* formed in a tub rear wall 20*b*. Air may pass through the third air circulation path 193 located behind the tub 20 and the drum 30. After air flows to the top end of the third air circulation path 193, the air may flow in the first air circulation path 191. The air may sequentially pass through the heat exchanger 171 in the first air circulation path 191. Air having a high humidity by the clothes of the drum interior 30*a* may become hot air having a low humidity while passing through the heat exchanger 171. The hot air with a low humidity may be blown by the fan 172 disposed at a downstream area of the heat exchanger 171. Air that has passed through the fan 172 may flow in the second air circulation path 192 in front of the tub 20 and the drum 30. Air in the second air circulation path 192 may pass through a communicating hole 182*c* formed at the diaphragm 50 at the bottom end of the second air circulation path 192 and flow back into the drum 30 after passing through the diaphragm 50. The hot air with a low humidity may become humid air again by the clothes contained in the drum interior 30*a* and then turn to hot air with a low humidity again by the above-described process.

Figure 5:
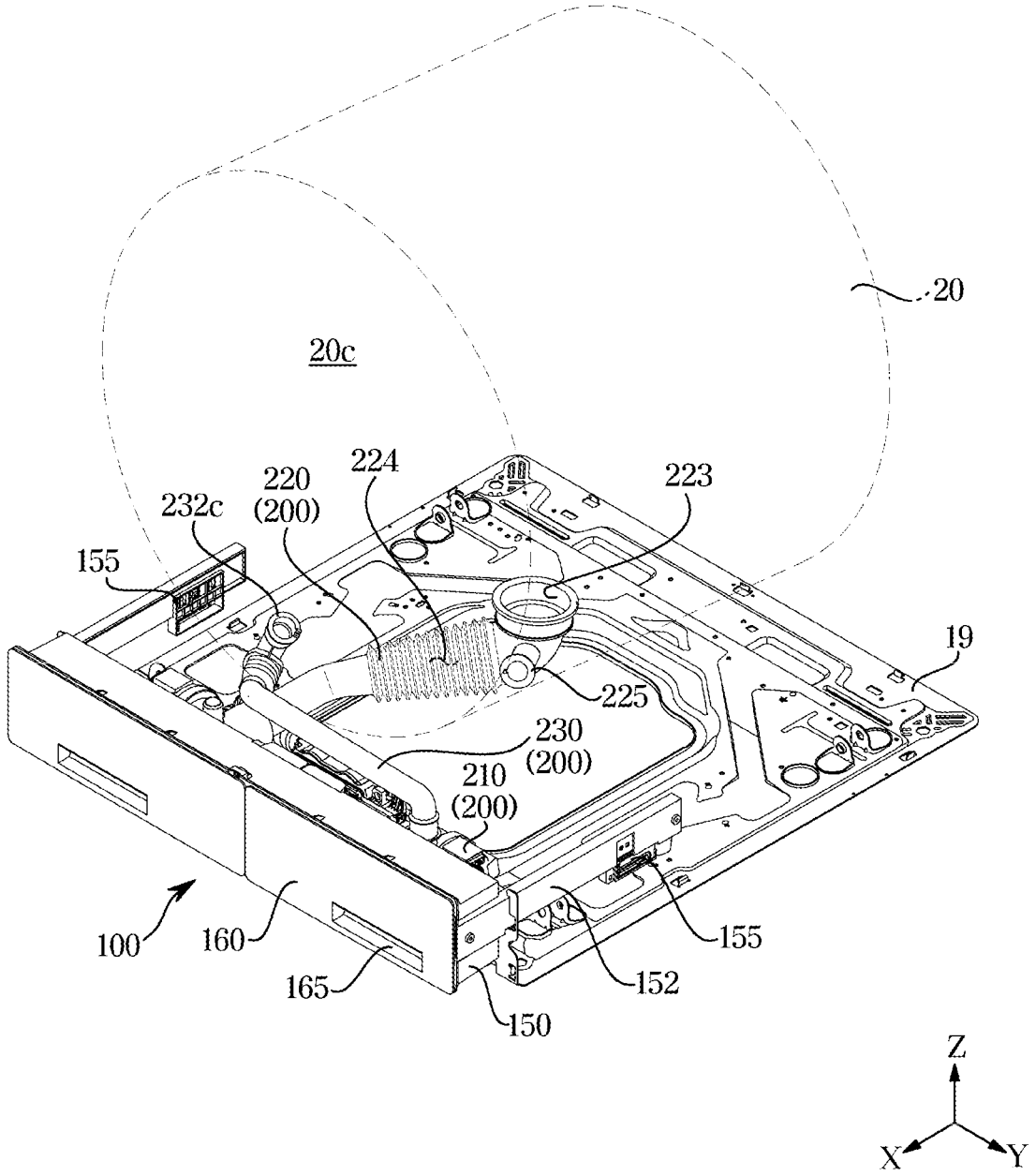
FIG. 5 is a perspective view showing a state where the cabinet is omitted from the clothes treating apparatus illustrated in FIG. 1.
Figure 6:
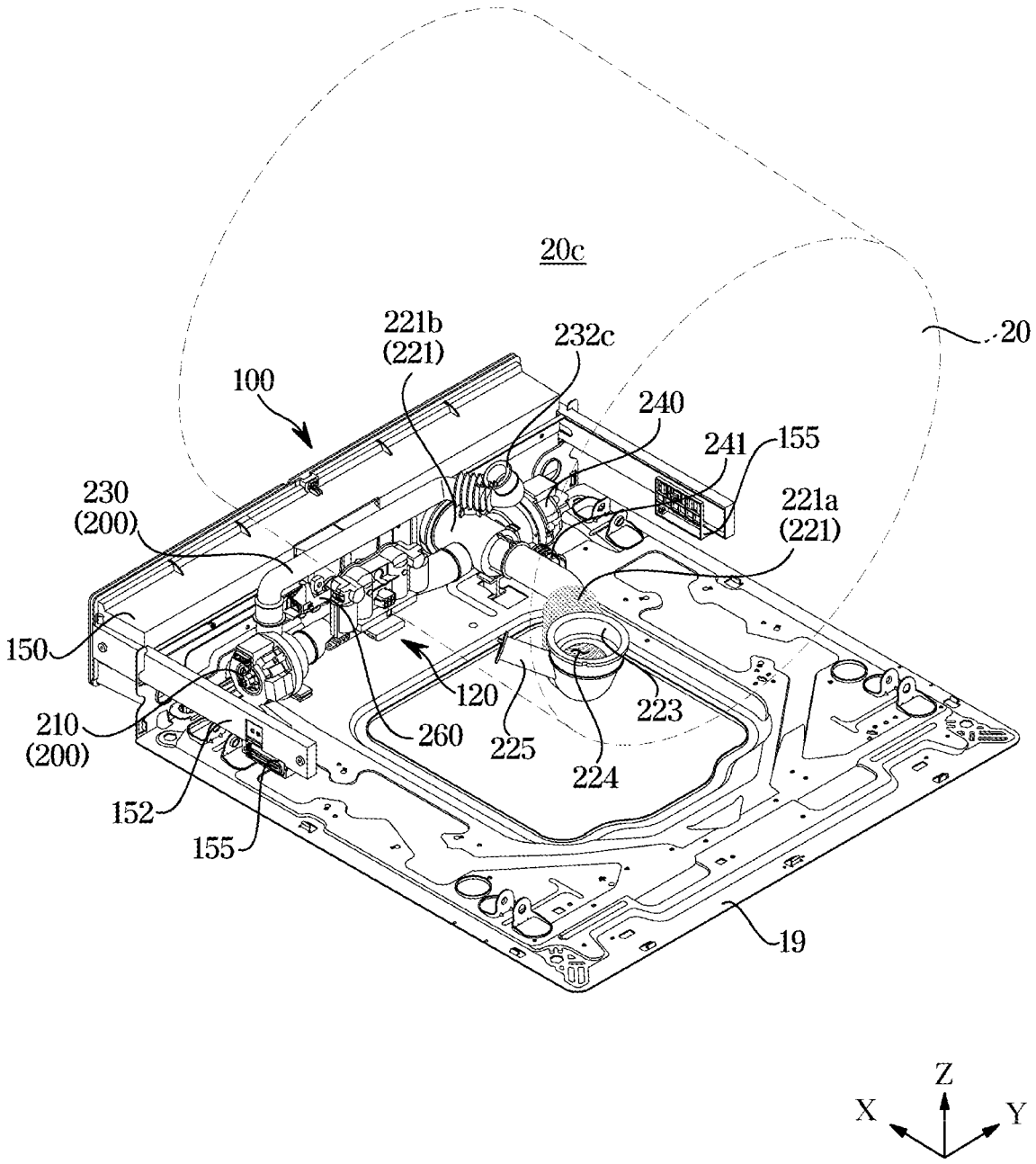
FIG. 6 is a perspective view of the clothes treating apparatus illustrated in FIG. 5.
Figure 7:
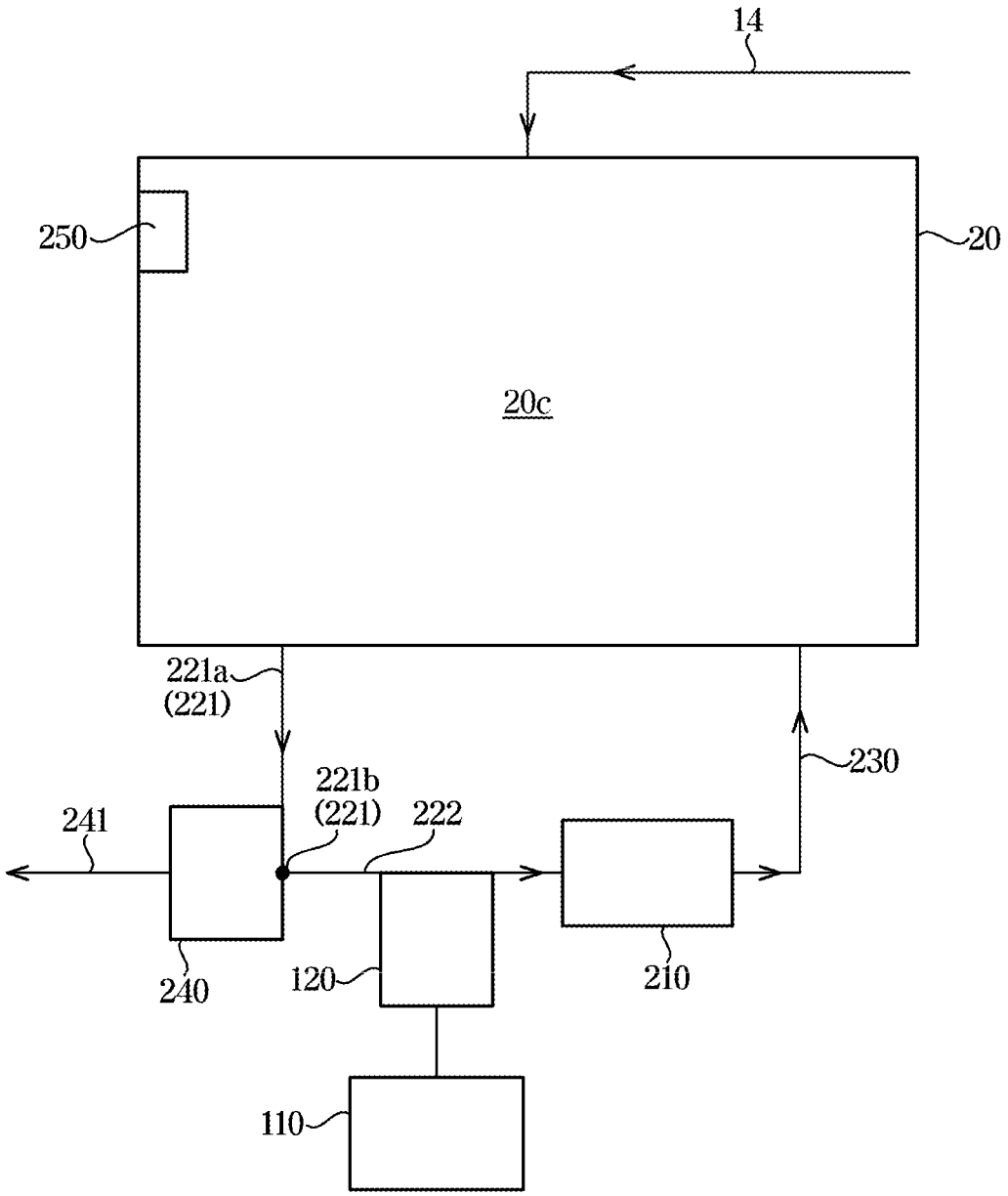
FIG. 7 is a block diagram schematically illustrating the clothes treating apparatus illustrated in FIG. 1.

FIG. 5 is a perspective view showing a state where the cabinet is omitted from the clothes treating apparatus illustrated in FIG. 1. FIG. 6 is a perspective view of the clothes treating apparatus illustrated in FIG. 5. FIG. 7 is a block diagram schematically illustrating the clothes treating apparatus illustrated in FIG. 1.

Referring to FIGS. 5 to 7, the clothes treating apparatus according to an embodiment of the present disclosure may include a water supply device 14, a tub 20, a circulation device 200, and a detergent supply device 100. In the following description, the detergent supply device 100 may be the first detergent supply device 100.

The circulation device 200 may include a circulation pump 210, a first circulation path 220, and a second circulation path 230. The circulation device 200 may allow water contained in the tub interior 20*c* to flow out of the tub 20 and back to the tub interior 20*c*. For example, the circulation device 200 may be disposed below the tub 20 and circulate water contained in the tub interior 20*c*. However, the position of the circulation device 200 is not limited to the above-described example.

In addition, although a plurality of separate circulation paths 220 and 230 are illustrated in the drawings, the embodiment is not limited thereto, and the circulation paths 220 and 230 may be integrated with each other. For example, the first circulation path 220 or the second circulation path 230 may be omitted and wash water may circulate via another circulation path. The plurality of circulation paths 220 and 230 may be referred to as a plurality of circulation guides 220 and The circulation pump 210 may be connected to the plurality of circulation paths 220 and 230 to allow water contained in the circulation paths 220 and 230 to flow into tub 20. The circulation pump 210 may be located at one side of the plurality of circulation paths 220 and 230. For example, the circulation pump 210 may be located on the left side (e.g., in the Y direction) of the first circulation path 220 under the second circulation path 230. The circulation pump 210 may operate optionally with a drain pump 240, which will be described below.

The first circulation path 220 may be provided to guide wash water from the tub 20 to the circulation pump 210. The first circulation path 220 may be disposed under the tub 20 and guide water drained from the tub interior 20*c* to the circulation pump 210. The first circulation path 220 may include a drain path 221 and a mixing path 222. The first circulation path 220 may be referred to as a first circulation guide 220.

The drain path 221 may be disposed under the tub 20 and guide water drained from the tub interior 20*c*. An inner flow path 224 may be formed in the drain path 221. The drain path 221 may guide water drained from the tub 20 to flow into the circulation pump 210 or to be discharged out of the washing machine 1. The drain path 221 may be referred to as a drain guide 221.

The drain path 221 may include a first drain path 221*a* and a second drain path 221*b*. The first drain path 221*a* may guide water discharged from the tub 20 to the second drain path 221*b*. The second drain path 221*b* may guide water discharged from the tub 20 to flow into the circulation pump 210 or to be discharged out of the washing machine. The inside of the second drain path 221*b* may be open or closed by the drain pump 240. The second drain path 221*b* may serve as a filter case 234 to which a filter is coupled. The drain pump 240 may be coupled to the second drain path 221*b*. The first drain path 221*a* may be referred to as a first drain guide 221*a* and the second drain path 221*b* may be referred to as a second drain guide 221*b*.

The mixing path 222 may be connected to the drain path 221. For example, the mixing path 222 may be connected to the second drain path 221*b* and guide wash water to the circulation pump 210. The mixing path 222 may be connected to the detergent supply device 100. For example, a detergent contained in the detergent case 110 of the detergent supply device 100 may be sucked into a detergent pump 120 and discharged into a mixing space 222*a* in the mixing path 222. Detailed descriptions thereof will be given below. Therefore, wash water and the detergent may be mixed in the mixing path 222, and the wash water mixed with the detergent may flow into the tub 20 after passing through the mixing path 222, the circulation pump 210, and the second circulation path 230. The mixing path 222 may be mounted on the detergent pump 120 which will be described below. Thus, the mixing path 222 may be directly connected to the detergent pump 120 without a separate part connecting the mixing path 222 with the detergent pump 120, and detergent residues may be minimized. The mixing path 222 may be referred to as a mixing guide 222.

The second circulation path 230 may be provided to guide wash water from the circulation pump 210 to the tub 20. The second circulation path 230 may be disposed under the tub 20 and guide wash water from the circulation device 200 to the tub interior 20*c*. The second circulation path 230 may be connected to the first circulation path 220 and the tub 20, respectively. The second circulation path 230 may be referred to as a second circulation guide 230. The second circulation path 230 may include a circulation pump case 231 and a supply pipe 232. Detailed descriptions thereof will be given below.

The detergent supply device 100 may be disposed at one side of the circulation device 200. The detergent supply device 100 may supply the detergent to the circulation device 200. The detergent supplied to the circulation device 200 may be mixed with wash water in the circulation device 200. The mixed detergent may flow into the tub 20 through the plurality of circulation paths 220 and 230.

The detergent supply device 100 may include the detergent pump 120 configured to suck a detergent from the detergent case 110 after docking with the detergent case 110, a housing 160 accommodating the detergent case 110 and provided to be withdrawn from the cabinet 10 and inserted into the cabinet 10, and a second drawer 150 accommodating the housing 160. The housing 160 may slide out from the inside of the second drawer 150. The second drawer 150 may be coupled to side walls 12*b* and 12*c* or side plates 12*b* and 12*c* of the cabinet 10.

The drain pump 240 may drain water discharged from the tub 20 out of the washing machine through the drain pipe 241. The drain pump 240 may be coupled to the second drain path 221*b* to open or close the inner flow path 224 in the second drain path 221*b*. The drain pump 240 may be turned on/off optionally with the circulation pump 210 by the detergent pump 120. For example, to circulate water in the washing machine, the circulation pump 210 may be driven.

On the contrary, to drain water, only the drain pump 240 may be driven, and therefore water may be drained out of the washing machine.

The washing machine may further include a switch. The switch may sense whether a first drawer is accommodated in the cabinet 10. For example, in response to insertion of that the second drawer 150 into the cabinet 10, a button (not shown) of the switch may be in a pressed state. In response to withdrawing of the second drawer 150 from the cabinet 10, the button (not shown) may be in a non-pressed state.

The washing machine may further include a sensor guide 225. The sensor guide 225 may protrude from the first drain guide 221*a*. The sensor guide 225 may be connected to a water level sensor 250. For example, the sensor guide 225 may be connected to the water level sensor 250 via a separate hose. For example, the water level sensor 250 may be an air sensor, and the water level in the sensor guide 225 may increase as the water level in the tub 20*c* increases. Accordingly, a pressure in the sensor guide 225 may increase in accordance with the increasing water level, and the water level sensor 250 may sense the water level of the tub interior 20*c* by sensing the same.

Referring to FIGS. 5 to 7, wash water circulating in the cabinet 10 will be described.

Water introduced from the outside of the washing machine 1 may enter the tub 20 through the water supply device 14. For example, the water supply device 14 may be disposed above the tub 20 to allow water to flow into the interior 20*c* of the tub 20.

The water level sensor 250 provided at one side of the tub 20 may sense an amount of water collected in the tub interior 20*c*. For example, the water level sensor 250 may be coupled to an upper portion of the tub 20 and sense the amount of wash water of the tub interior 20*c*. For example, upon determination that the water level of the tub 20 sensed by the water level sensor 250 is ⅓ or more, a processor 300 may operate the circulation pump 210 in response thereto. Alternatively, the processor 300 may operate the drain pump 240 to drain water contained in the tub interior 20*c* out of the washing machine. In this case, the first circulation path 220, the second circulation path 230, and the like below the tub 20 may be filled with water in the cabinet 10.

Although the water level sensor 250 disposed in the interior 20*c* of the tub 20 is illustrated in the drawing, the position of the water level sensor 250 is not limited to the above-described example.

Hereinafter, the embodiment will be described based on the operation of the circulation pump 210.

In response to the operation of the circulation pump 210, water contained in the tub interior 20*c* may flow to the circulation device 200 through the drain hole 223 disposed under the tub 20. For example, water contained in the tub interior 20*c* may flow to the inner flow path 224 through the first circulation path 220 or the drain hole 223 of the drain path 221.

Wash water may be discharged from the tub 20 through the first drain path 221*a* and guided to the second drain path 221*b*. Because a filter (not shown) is provided in the second drain path 221*b*, wash water may be filtered by the filter. Wash water guided to the second drain path 221*b* may be guided to the mixing path 222. In this regard, in response to the operation of the detergent pump 120, the detergent may be discharged to mixing space 222*a* in the mixing path 222 from the detergent pump 120. Wash water may be mixed with the detergent while passing through the mixing path 222.

Wash water mixed with the detergent may be guided toward the circulation pump 210. Wash water may flow to the second circulation path 230 through the circulation pump 210. Because the second circulation path 230 may be connected to the first circulation path 220 and the tub 20, respectively, wash water that has passed through the first circulation path 220 and the circulation pump 210 may flow into the tub interior 20*c*.

The embodiment will be described based on the operation of the drain pump 240.

In response to the operation of the drain pump 240, water contained in the tub interior 20*c* may flow to the circulation device 200 through the drain hole 223 disposed under the tub 20. For example, water contained in the tub interior 20*c* may flow to the inner flow path 224 through the first circulation path 220 or the drain hole 223 of the drain path 221.

Wash water may be discharged from the tub 20 through the first drain path 221*a* and guided to the second drain path 221*b*. Because a filter (not shown) is provided in the second drain path 221*b*, wash water may be filtered by the filter. The drain pump 240 may serve as a valve to open and close the inner flow path 224, and the inner flow path 224 may be open and closed by operating the drain pump 240. In response to the opening of the inner flow path 224, wash water guided to the second drain path 221*b* may be guided out of the washing machine 1 through the drain pipe 241. In this case, the detergent pump 120 and/or the circulation pump 210 may be in an off-state.

Figure 8:
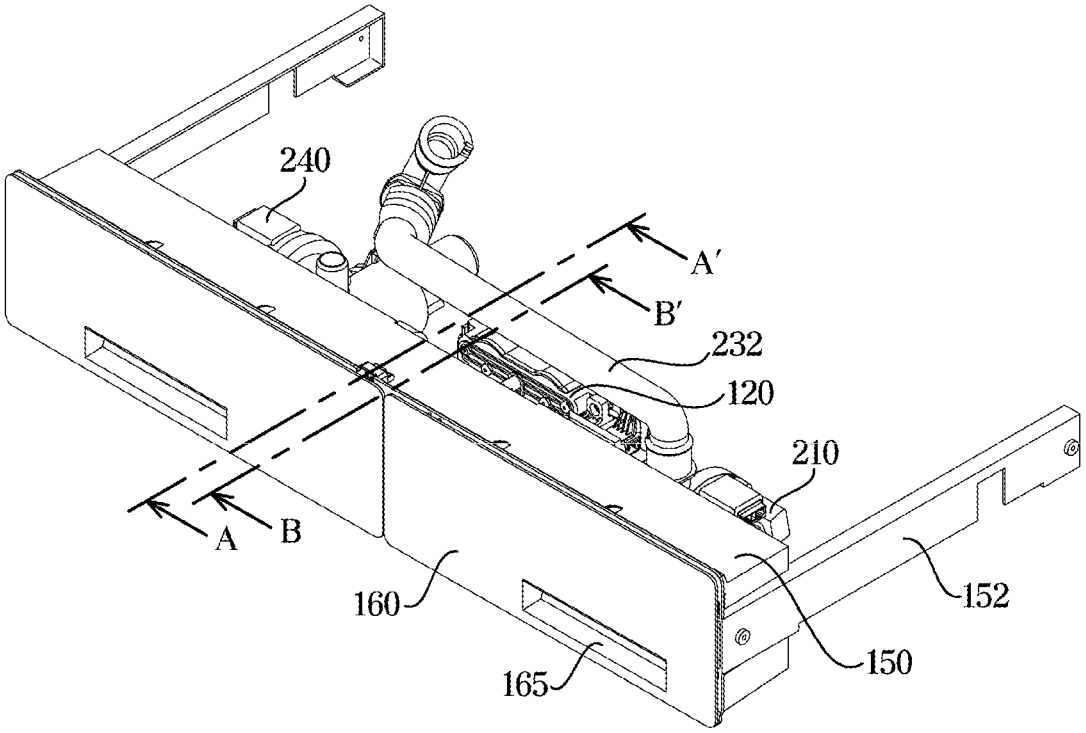
FIG. 8 is a perspective view of the detergent supply device and the circulation device of the clothes treating apparatus illustrated in FIG. 1.
Figure 9:
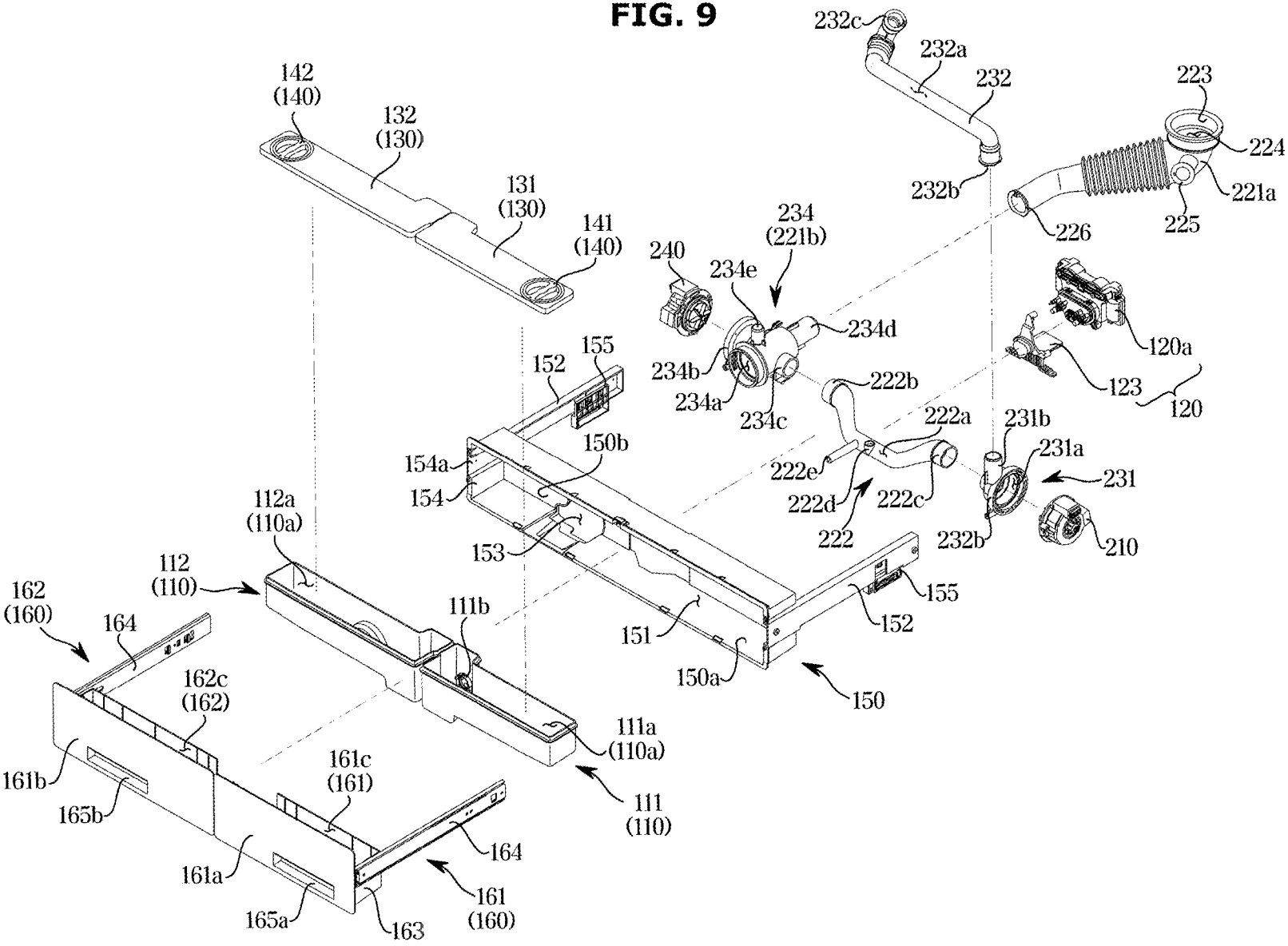
FIG. 9 is an exploded perspective view of the detergent supply device and the circulation device illustrated in FIG. 8.

FIG. 8 is a perspective view of the detergent supply device and the circulation device of the clothes treating apparatus illustrated in FIG. 1. FIG. 9 is an exploded perspective view of the detergent supply device and the circulation device illustrated in FIG. 8.

Referring to FIGS. 8 and 9, the clothes treating apparatus according to an embodiment of the present disclosure may include the detergent supply device 100 and the circulation device 200.

The detergent supply device 100 may include a detergent case 110, a detergent pump 120, a detergent case cover 130, a cap 140, a second drawer 150, and a housing 160.

The detergent case 110 may be docked with the detergent pump 120. Upon docking of the detergent case 110 with the detergent pump 120, the detergent of the accommodating space 110*a* of the detergent case 110 may be discharged into the mixing path 222 via the detergent pump 120.

The detergent case 110 may be inserted into the second drawer 150 or withdrawn from the second drawer 150 in a state of being accommodated in the housing 160. The detergent case 110 may be inserted into a receiving space 151 or withdrawn from the receiving space 151 via the opening 150*a* of the second drawer 150. The detergent case 110 and the housing 160 may be slided out from the second drawer 150.

The detergent case 110 may include a first detergent case 111, a second detergent case 112, and a pump connector 111*b*.

The detergent case 110 may store a main detergent (powder detergent or liquid detergent), a preliminary detergent, a fabric softener and/or a bleach.

A main laundry detergent, a fabric softener, and/or a rinse may be contained in the first detergent case 111 and/or the second detergent case 112. For example, the main laundry detergent may be contained in the first detergent case 111, and the fabric softener or the preliminary detergent may be contained in the second detergent case 112. However, types of the detergent contained therein and/or size of the detergent case 110 are not limited to the above-described example. The first detergent case 111 and the second detergent case 112 may be disposed inside the housing 160. The first detergent case 111 may form a first accommodating space 111*a* and the second detergent case 112 may form a second accommodating space 112*a*. For example, the main laundry detergent may be contained in the first accommodating space 111*a*, and the fabric softener, the preliminary detergent, or the like may be contained in the second accommodating space 112*a*.

Although the drawings illustrate a plurality of detergent cases 110 partitioned and separated from each other, the embodiment is not limited thereto.

The pump connector 111*b* may be formed at the rear of the first detergent case 111 and at the rear of the second detergent case 112, respectively. The pump connector 111*b* may serve as an outlet 111*b*. Although the outlet 111*b* is formed only at the first detergent case 111 in the drawing, the outlet 111*b* may also be formed at the second detergent case 112. The outlet 111*b* may allow the detergent contained in the first accommodating space 111*a* and/or the second accommodating space 112*a* to flow into the detergent pump 120 via a pipe (not shown). For example, upon docking of the detergent case 110 with the detergent pump 120, the detergent may flow into the detergent pump 120 through the outlet 111*b* and then into the mixing space 222*a* of the mixing path 222. However, the position of the outlet 111*b* is not limited to that shown in the drawing.

The detergent case cover 130 may be configured to cover the top of the detergent case 110. For example, the detergent case cover 130 may be configured to cover the top end of the detergent case 110. The detergent case cover 130 may include a first detergent case cover 131 configured to cover the top of the first detergent case 111 to correspond to the first accommodating space 111*a*, and a second detergent case cover 132 configured to cover the top of the second detergent case 112 to correspond to the second accommodating space 112*a*.

The cap 140 may be coupled to the detergent case cover 130. The cap 140 may be removed in the case where the user adds a detergent into the interior 111*a* and 112*a* of the detergent case 110. Upon completion of adding the detergent into the interior 111*a* and 112*a* of the detergent case 110 by the user, the cap 140 may be mounted on the detergent case cover 130 again. The interior 111*a* and 112*a* of the detergent case 110 may serve as the accommodating spaces 111*a* and 112*a* of the detergent case 110.

The cap 140 may include a first cap 141 and a second cap 142. The first cap 141 may be mounted on the first detergent case cover 131, and the second cap 142 may be mounted on the second detergent case cover 132.

The detergent pump 120 may be disposed behind the second drawer 150 and the detergent case 110. Upon docking with the detergent case 110 inserted into the second drawer 150, the detergent pump 120 may suck the detergent contained in the detergent case 110 and discharge the sucked detergent into the mixing space 222*a* in the mixing path 222. For example, upon docking of the outlet 111*b* of the detergent case 110 with first mover 121*a* of the detergent pump 120, the detergent contained in the detergent case 110 may flow into the detergent pump 120 through the outlet 111*b* and the first mover 121*a* and then flow into the mixing space 222*a* through the second mover 121*b*. The detergent flowing into the mixing space 222*a* may be mixed with water entering the tub interior 20*c* through the mixing path 222.

The second drawer 150 may accommodate the housing 160 and the detergent case 110. The housing 160 and the detergent case 110 may be withdrawn from or inserted into the second drawer 150 via the opening 150*a*. The second drawer 150 may serve as the case 150. The second drawer 150 is coupled to a side wall of the cabinet 10 to accommodate the first drawer and may be slidably coupled to the first drawer such that the first drawer slides.

The second drawer 150 may include a receiving space 151, a sliding coupler 152, a filter coupler 153, a rail coupler 154*a*, and a stopper 155.

The receiving space 151 may be formed inside the second drawer 150. The housing 160 and the detergent case 110 may be disposed in the receiving space 151.

The sliding couplers 152 may be formed from both side walls 154 of the second drawer 150. The sliding couplers 152 may extend backward from both side walls 154. The sliding couplers 152 may be coupled to side plates 12*b* and 12*c* of the cabinet 10. The sliding coupler 152 may be provided in plural. A plurality of sliding couplers 152 may extend backward from the left wall 154 and/or the right wall 154 of the second drawer 150.

The filter coupler 153 may be formed by opening a part of a rear wall 150*b* of the second drawer 150. The filter case 234 may be coupled to the filter coupler 153.

The rail coupler 154*a* may be formed by being recessed from an inner wall 154 of the second drawer 150. The rail coupler 154*a* may be provided in plural. For example, the rail coupler 154*a* may be formed by being recessed from inner surfaces of the left wall 154 and/or the right wall 154 of the second drawer 150. The rail coupler 154*a* may be slidably coupled to a rail 164 of the housing 160. For example, the rail 164 of the housing 160 may be coupled to the rail coupler 154*a* and the housing 160 may slide.

The stopper 155 may fix the rail 164 in a state where the second drawer 160 is inserted into or accommodated in the cabinet 10. The stopper 155 may be mounted at the sliding coupler 152. The stopper 155 may be provided in plural.

The housing 160 may accommodate the detergent case 110, the detergent case cover 130, and the cap 140. The housing 160 may be slidably coupled to the second drawer 150. The user may add the detergent into the interior 111*a* and 112*a* of the detergent case 110 accommodated in the housing 160 by pulling the housing 160 from the cabinet 10 and then insert the housing 160 into the cabinet 10 again.

The housing 160 may serve as a first drawer. The housing 160 may be provided to be withdrawn from or inserted into the cabinet 10.

The housing 160 may be provided in plural. The plurality of housings 160 may include a first housing 161 and a second housing 162. The first housing 161 may accommodate the first detergent case 111, and the second housing 162 may accommodate the second detergent case 112. Each of the housings 161 and 162 may include a handle 165*a* or 165*b*, an accommodating space 161*c* and 162*c*, and a rail 164.

The handles 165*a* and 165*b* may be formed at the front surfaces 161*a* and 161*b* of the housing 160. The handles 165*a* and 165*b* may be recessed from the front surfaces 161*a* and 161*b*. The handles 165*a* and 165*b* may be provided in plural. The first handle 165*a* may be formed at the front surface 161*a* of the first housing 161, and the second handle 165*b* may be formed at the front surface 161*b* of the second housing 162. The user may hold the detergent case 110 via the handles 165*a* and 165*b* and insert the detergent case 110 into the cabinet 10 or withdraw the detergent case 110 from the cabinet 10.

The second housing 162 may accommodate the detergent case 110, the detergent case cover 130, and the cap 140. The top end of the second housing 162 may be open. The detergent case 110, the detergent case cover 130, and the cap 140 may be separated from the housing 160 through the top side of the accommodating space 162.

The rail 164 may be coupled to a side wall 163 of the housing 160. The rail 164 may be provided in plural. For example, the first rail 164 may be coupled to a left wall 163 of the first housing 161, and the second rail 164 may be coupled to a right wall of the second housing 162.

The circulation device 200 may circulate water contained in the tub interior 20*c*. For example, the circulation device 200 may allow water contained in the tub interior 20*c* to flow out of the tub 20 and back into the tub interior 20*c*. The circulation device 200 may include the circulation pump 210, the first circulation path 220, and the second circulation path 230.

The circulation pump 210 may be disposed on the left below the tub 20. The circulation pump 210 may pump wash water to introduce wash water flowing in the circulation device 200 into the tub 20. The circulation pump 210 may be mounted on the circulation pump case 231. For example, the circulation pump 210 may be mounted on a circulation pump mount 231*a* provided at the circulation pump case 231. The circulation pump 210 may open or close flow paths 222*a* and 232*a* provided in the circulation device 200.

The first circulation path 220 may allow wash water to flow into the circulation pump 210 from the tub 20. The first circulation path 220 may include the drain path 221 and the mixing path 222.

The drain path 221 may allow water discharged from the tub 20 to flow into the circulation pump 210 or to flow out of the washing machine. The drain path 221 may include the first drain path 221*a* and the second drain path 221*b*.

The first drain path 221*a* may guide water discharged from the tub 20 to the second drain path 221*b*. A first end of the first drain path 221*a* may be connected to the tub 20, and a second end 226 of the first drain path 221*a* may be connected to the second drain path 221*b*. The drain hole 223 may be formed at the first end of the first drain path 221*a*. The inner flow path 224 may be formed in the first drain path 221*a*.

The second drain path 221*b* may guide water discharged from the tub 20 to flow into the circulation pump 210 or to flow out of the washing machine. The second drain path 221*b* may be connected to the first drain path 221*a*. The second drain path 221*b* may branch the inner flow path 224 formed in the first drain path 221*a*. The second drain path 221*b* may serve as a filter case 234 to which a filter is coupled.

The filter case 234 may include a filter mount 234*a*, a drain pump mount 234*b*, a mixing guide mount 234*c*, a first drain guide connector 234*d*, and a spray nozzle connector 234*e*. Also, the drain pipe 241 (See FIG. 6) may be formed at one side of the filter case 234. The drain pipe 241 may be a first drain pipe 241.

The filter mount 234*a* may be formed in the filter case 234. A filter (not shown) may be mounted on the filter mount 234*a* to filter water discharged from the tub 20.

The drain pump 240 may be mounted on the drain pump mount 234*b*. The drain pump 240 may open or close the inner flow path 224. For example, the drain pump 240 may open or close the flow path in the filter case 234. In response to the operation of the drain pump 240, water that has passed through the first drain path 221*a* and the second drain path 221*b* may flow out of the washing machine. The drain pump mount 234*b* may be formed on the right side of the filter case 234.

The mixing path 222 may be mounted on the mixing guide mount 234*c*. For example, the mixing guide mount 234*c* may be connected to a second drain guide connector 222*b* of the mixing path 222. Accordingly, water that has passed through the drain path 221 may flow into the mixing path 222. The mixing guide mount 234*c* may be formed on the left side of the filter case 234.

The first drain guide connector 234*d* may be connected to the first drain path 221*a*. For example, the first drain guide connector 234*d* may be connected to the second end 226 of the first drain path 221*a*.

The spray nozzle connector 234*e* may be connected to the spray nozzle 70 spraying wash water into the tub 20 and/or the drum 30. The spray nozzle connector 234*e* may protrude upward.

The mixing path 222 may guide water that has passed through the drain path 221 to the circulation pump 210. The mixing space 222*a* may be formed in the mixing path 222. In the mixing space 222*a*, wash water may be mixed with the detergent introduced into the mixing space 222*a* from the detergent case 110 through the detergent pump 120. The mixing path 222 may be disposed under the detergent case 110 and the detergent pump 120 (See FIGS. 11 and 12). The mixing path 222 may be directly connected to the detergent pump 120 without using a hose or pipe interposed therebetween. Therefore, the possibility of solidification of a detergent remaining in a hose or pipe, which connects the mixing path 222 with the detergent pump 120, may be significantly reduced.

The mixing path 222 may include a mixing space 222*a*, a second drain guide connector 222*b*, a circulation pump communicator 222*c*, and a drain pipe 222*e*. The mixing space 222*a* may be formed in the mixing path 222 and wash water may be mixed with the detergent therein.

The second drain guide connector 222*b* may be disposed on the right side of the mixing path 222 and connected to the mixing guide mount 234*c*. Thereby, wash water contained in the drain path 221 may flow into the mixing space 222*a* and the detergent may be mixed with wash water.

The circulation pump communicator 222*c* may be disposed on the left side of the mixing path 222 to be connected to the circulation pump 210 and/or the circulation pump case 231. Thereby, wash water contained in the mixing space 222*a* may be pumped by the circulation pump 210 to flow into the tub 20.

The drain pipe 222*e* may be a second drain pipe 222*e*. The second drain pipe 222*e* may be provided to remove water remaining after the rinsing operation of the washing machine. For example, the second drain pipe 222*e* may be blocked with a plug, and the user may remove water remaining in the mixing space 222*a* by removing the plug, if required.

The second circulation path 230 may be provided to guide wash water from the circulation pump 210 to the tub 20. The second circulation path 230 may be connected to the first circulation path 220 and the tub 20, respectively. The second circulation path 230 may include the circulation pump case 231 and the supply pipe 232.

The circulation pump case 231 may accommodate a part of the circulation pump 210. The circulation pump case 231 may include a circulation pump mount 231*a* and a supply pipe mount 231*b*.

The circulation pump mount 231*a* may be formed at one side of the circulation pump case 231 in an open state. For example, the circulation pump mount 231*a* may be formed on the left side of the circulation pump case 231. The circulation pump 210 may be mounted on the circulation pump mount 231*a*.

The supply pipe mount 231*b* may extend upward from the circulation pump case 231. The supply pipe mount 231*b* may protrude toward the supply pipe 232. For example, the supply pipe mount 231*b* may be connected to a first end 232*b* of the supply pipe 232. The first end 232*b* of the supply pipe 232 may be a lower end 232*b*. The lower end 232*b* of the supply pipe 232 may serve as a circulation pump connector 232*b*.

The supply pipe 232 may allow wash water pumped by the circulation pump 210 to flow into the tub 20 from the circulation pump case 231. A supply flow path 232*a* may be formed in the supply pipe 232. The supply flow path 232*a* may connect the mixing space 222*a* with the interior 20*c* of the tub 20. The supply pipe 232 may be connected to the circulation pump 210 and the tub 20, respectively. The first end 232*b* of the supply pipe 232 may serve as a circulation pump connector 232*b* connected to the circulation pump 210. A second end 232*c* of the supply pipe 232 may serve as a tub connector 232*c* connected to the tub 20. The second end 232*c* of the supply pipe 232 may be an upper end 232*c*.

Figure 10:
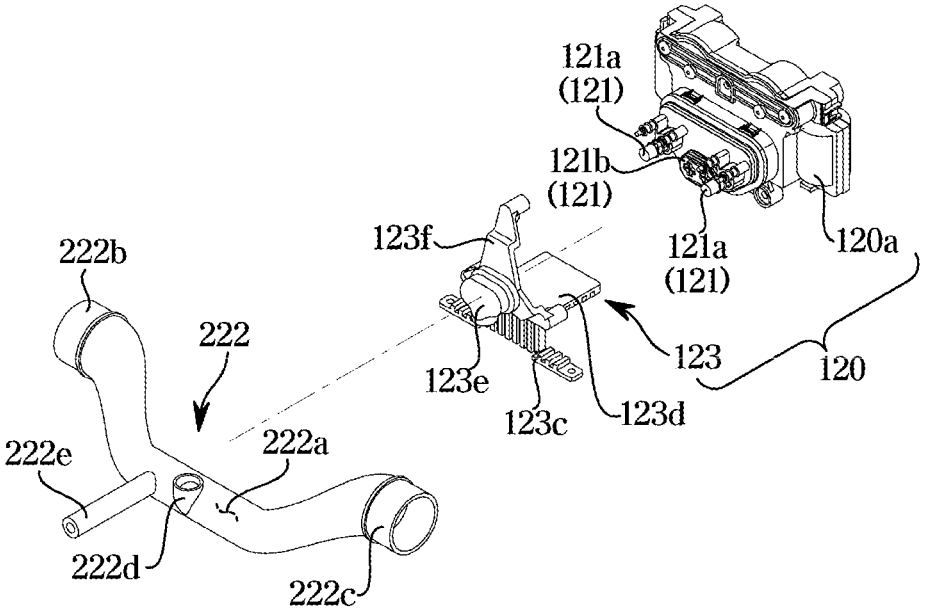
FIG. 10 is an exploded perspective view of the detergent pump illustrated in FIG. 9.

FIG. 10 is an exploded perspective view of the detergent pump illustrated in FIG. 9.

Referring to FIG. 10, the detergent supply device 100 may include the detergent pump 120 in the washing machine according to an embodiment of the present disclosure.

The detergent pump 120 may include a pump 120*a* and a mounting member 123. The mounting member 123 may be mounted on the front of the pump 120*a*. The mounting member 123 may be a cover member 123 covering the pump 120*a*.

A mover 121 may be formed at the front of the pump 120*a*. The mover 121 may include a first mover 121*a* and a second mover 121*b*. The first mover 121*a* may allow the detergent to flow into the pump 120*a* from the detergent case 110. The second mover 121*b* may allow the detergent to flow into the mixing space 222*a* from the pump 120*a*. The first mover 121*a* and the second mover 121*b* may protrude forward. However, the shapes of the first mover 121*a* and the second mover 121*b* are not limited to the above-described example.

The mounting member 123 may support the pump 120*a*. In addition, the mounting member 123 may cover the front of the pump 120*a* to protect the second mover 121*b* and allow the second mover 121*b* to communicate with the mixing path 222. The mounting member 123 may be mounted on the mixing path 222.

The mounting member 123 may include supports 123*c* and 123*d* and a mount. The supports 123*c* and 123*d* may be provided in plural. The plurality of supports 123*c* and 123*d* may include a first support 123*c* and a second support 123*d*.

The first support 123*c* may support the pump 120*a* at the bottom plate 19 and/or bottom. The first support 123*c* may vertically extend. The second support 123*d* may be bent from the top end of the first support 123*c* and extend backward. The second support 123*d* may support the bottom of the pump 120*a*.

The mounts 123*e* and 123*f* may be provided in plural. The plurality of mounts 123*e* and 123*f* may include a first mount 123*e* and a second mount 123*f*.

The first mount 123*e* may allow the second mover 121*b* to communicate with the mixing path 222. The first mount 123*e* may form an outlet 123*a*. The detergent contained in the detergent pump 120 may flow into the mixing path 222 through the outlet 123*a*. The first mount 123*e* may protrude forward from the second mount 123*f*. However, the shape of the first mount 123*e* is not limited to the example shown in the drawing. The first mount 123*e* may allow the mounting member 123 to be mounted on the mixing path 222. The first mount 123*e* may protect the second mover 121*b* and cover the second mover 121*b*. The first mount 123*e* may serve as a cover 123*e*.

The second mount 123*f* may be formed near the first mount 123*e*. The second mount 123*f* may allow the mounting member 123 to be mounted on the pump 120*a*. Ends of the second mount 123*f* may extend toward the pump 120*a* to be mounted on the pump 120*a*.

Figure 11:
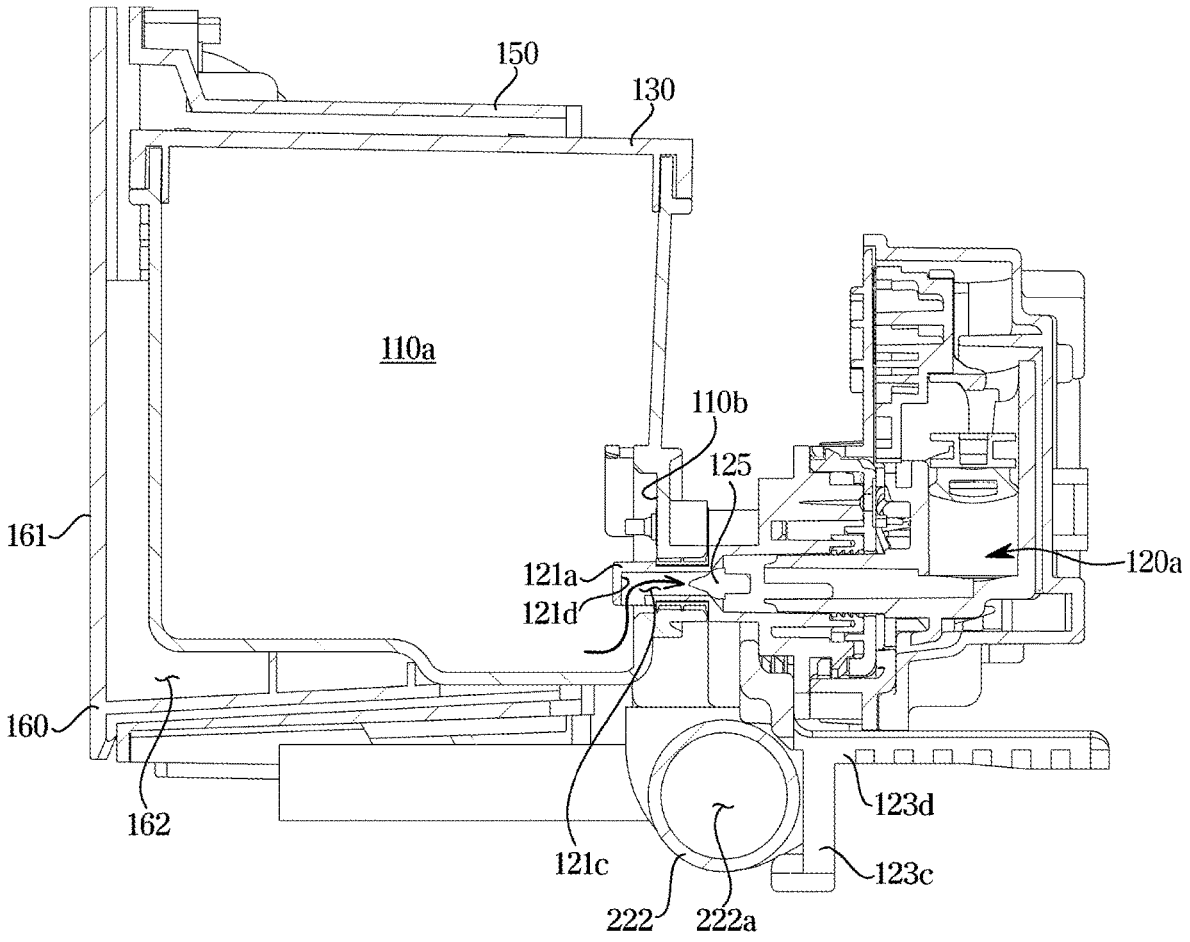
FIG. 11 is a cross-sectional view of the detergent supply device illustrated in FIG. 8.
Figure 12:
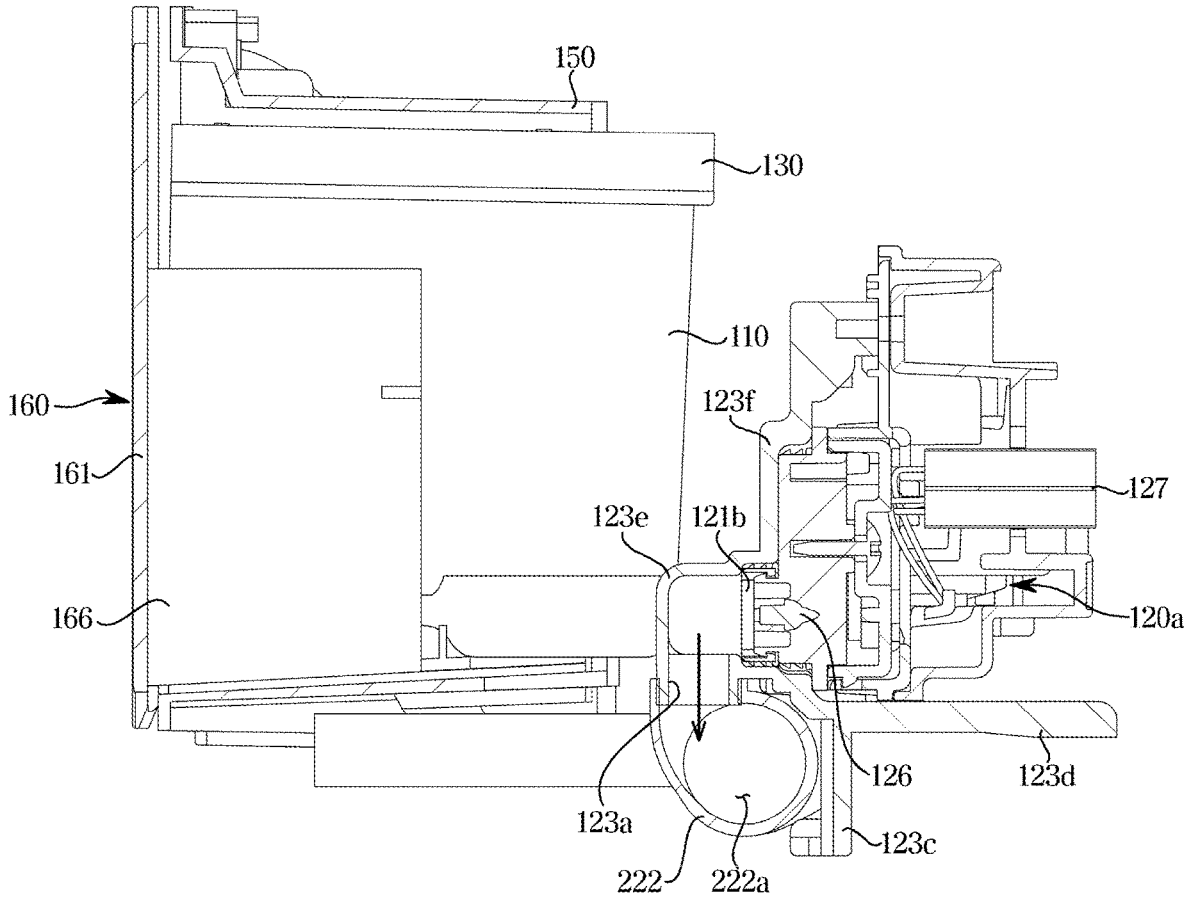
FIG. 12 is a cross-sectional view of the detergent supply device illustrated in FIG. 8.

FIG. 11 is a cross-sectional view of the detergent supply device and the circulation device illustrated in FIG. 8. FIG. 12 is a cross-sectional view of the detergent supply device and the circulation device illustrated in FIG. 8. FIG. 11 is a cross-section view of the detergent supply device and the circulation device taken along line A-A' of FIG. 8. FIG. 12 is a cross-sectional view of the detergent supply device and the circulation device taken along line B-B' of FIG. 8.

Referring to FIGS. 11 and 12, the detergent supply device 100 according to an embodiment of the present disclosure may include a detergent case 110, a barrier wall 166 partitioning a plurality of detergent cases 110, an accommodating space 110*a* formed in the detergent case 110, a detergent pump 120 configured to suck a detergent contained in the accommodating space 110*a* and discharge the detergent into a mixing space 222*a* in response to docking with the detergent case 110, a housing 160 accommodating the detergent case 110 and allowing the detergent case 110 to slide in a forward/backward direction, and a case (second drawer) accommodating the detergent case 110 and the housing 160.

In addition, the detergent pump 120 may include a pump 120*a*, and a mounting member 123 coupled to the pump 120*a* in front of the pump 120*a* and mounted on the mixing path 222. The mounting member 123 may be located on the mixing path 222. Therefore, the detergent passing through the interior 123*b* of the mounting member 123 may immediately flow into the mixing space 222*a* where wash water flows, and thus an amount of the detergent remaining between the detergent pump 120 and the mixing path 222 may be minimized.

The detergent pump 120 may include a connector 127 electrically and/or physically connected to a device outside the detergent pump 120. The connector 127 may be disposed behind the pump 120*a*.

In addition, the circulation device 200 according to an embodiment of the present disclosure may include the mixing path 222 constituting the mixing space 222*a*.

Referring to FIGS. 11 and 12, a flow path of the detergent contained in the accommodating space 110*a* of the detergent case 110 will be described.

The accommodating space 110*a* may store the detergent. In response to docking of the detergent case 110 with the detergent pump 120 or the operation of the detergent pump 120, the detergent may be introduced into the pump 120*a* through the mover 121. For example, the detergent may be introduced into the flow path 121*c* via the inlet 121*d* and enter the pump 120*a* by pushing a first valve 125. The detergent introduced into the pump 120*a* may be discharged out of the pump 120*a* by pushing a second valve 126. The detergent discharged from the pump 120*a* may flow into the mixing space 222*a* via the outlet 123*a* formed at one end of the mounting member 123 from the interior 123*b* of the mounting member 123. The outlet 123*a* may communicate with the mixing space 222*a*. For example, the outlet 123*a* may be connected to the inlet 222*d*.

Because wash water circulating in the circulation device 200 pass through the mixing space 222*a*, the detergent may be immediately mixed with wash water. Wash water mixed with the detergent, i.e., mixed water, may flow into the tub interior 20*c* through the circulation pump 210 and the second circulation path 230.

Figure 13:
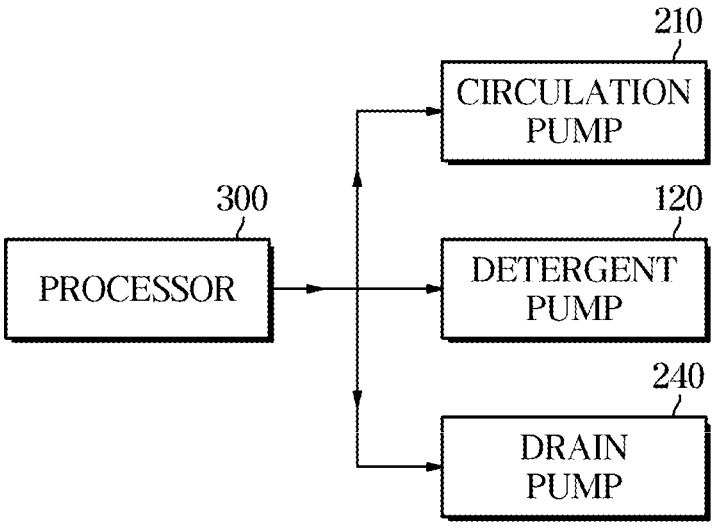
FIG. 13 is a control block diagram of the clothes treating apparatus illustrated in FIG. 1.
Figure 14:
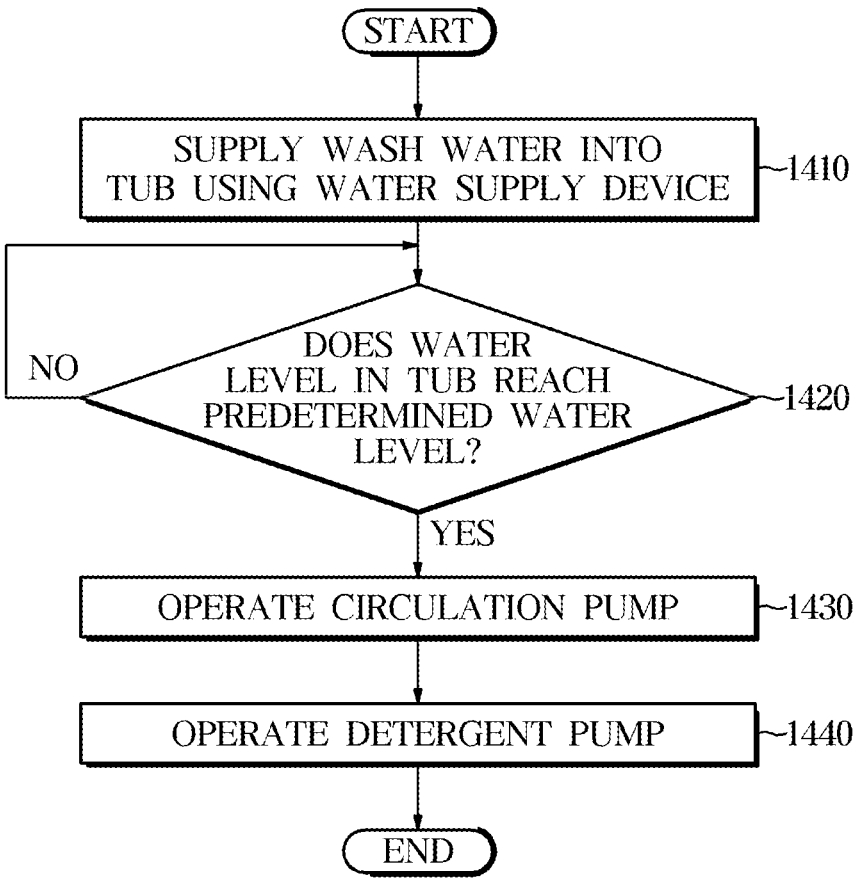
FIG. 14 is a control flow chart of the clothes treating apparatus illustrated in FIG. 1.

FIG. 13 is a control block diagram of the clothes treating apparatus illustrated in FIG. 1. FIG. 14 is a control flow chart of the clothes treating apparatus illustrated in FIG. 1.

Referring to FIGS. 13 and 14, the washing machine according to an embodiment of the present disclosure may include a processor 300. The processor 300 may control the circulation pump 210, the detergent pump 120, and the drain pump 240. For example, the processor 300 may turn on/off the circulation pump 210, the detergent pump 120, and/or the drain pump 240. In addition, the processor 300 may optionally operate the circulation pump 210 or the drain pump 240. For example, the processor 300 may turn on the circulation pump 210 and turn off the drain pump 240. On the contrary, the processor 300 may turn off the circulation pump 210 and turn on the drain pump 240.

Referring to FIGS. 7 to 14, a sequence of controlling the operation of the circulation device 200 in the washing machine according to an embodiment of the present disclosure will be described.

Water (wash water) may be supplied to the washing machine 1 from the outside through the water supply device 14. The water supply device 14 may supply wash water into the interior 20*c* of the tub 20 (1410). In this case, because flow paths connected to the tub 20 are closed, water may be collected in the tub 20. The processor 300 may sense a water level of the tub interior 20*c* using the water level sensor 250 provided at an upper portion of the tub 20. In the case where the water level of the tub interior 20*c* reaches a predetermined water level, the circulation pump 210 may operate (1420). For example, upon determination that the water level of the tub interior 20*c* reaches ⅓ or more of a height of the tub 20, the processor 300 may operate the circulation pump 210 (1430). In response to the operation of the circulation pump 210, water contained in the tub interior 20*c* may flow into the circulation device 200 disposed below the tub 20. For example, upon the operation of the circulation pump 210, water contained in the tub interior 20*c* may be guided through the drain path 221 to flow toward the mixing path 222.

For example, wash water may be discharged from the tub 20 through the first drain path 221*a* and guided to the second drain path 221*b*. Wash water guided to the second drain path 221*b* may be guided to the mixing path 222.

In response to the operation of the circulation pump 210, the detergent pump 120 may operate (1440). The detergent pump 120 may suck the detergent from the detergent case 110 and migrate the detergent to the mixing space 222*a* formed in the mixing path 222 (See FIGS. 11 and 12). For example, the detergent may be discharged into the mixing space 222*a* of the mixing path 222 from the detergent pump 120. Accordingly, wash water passing through the mixing space 222*a* may be mixed with the detergent discharged from the detergent pump 120.

Wash water mixed with the detergent may be guided to the circulation pump 210. The wash water may flow to the second circulation path 230 after passing through the circulation pump 210. Because the second circulation path 230 is connected to the first circulation path 220 and the tub 20, respectively, wash water that has passed through the first circulation path 220 and the circulation pump 210 may flow to the tub interior 20*c*.

On the contrary, the processor 300 may also operate the drain pump 240 without operating the circulation pump 210. As described in FIG. 7, in response to the operation of the drain pump 240, wash water of the tub interior 20*c* may flow into the inner flow path 224 through the first circulation path 220 or the drain holes 223 of the drain path 221.

Wash water may be discharged from the tub 20 through the first drain path 221*a* and guided to the second drain path 221*b*. The drain pump 240 may serve as a valve opening or closing the inner flow path 224, and the inner flow path 224 may be open or closed by operating the drain pump 240. In response to the opening of the inner flow path 224, wash water guided to the second drain path 221*b* may be guided out of the washing machine 1 through the drain pipe 241.

Meanwhile, the washing machine may include a plurality of detergent cases 111 and 112. In addition, the washing machine may include a plurality of modes including a washing mode, a spin-drying mode, a rinsing mode, a drying mode, and the like.

In response to the operation of the circulation pump 210, the processor 300 may operate the detergent pump 120 such that the detergent contained in the first detergent case 111 flows to the mixing space 222*a* through the detergent pump 120. Thereby, a washing mode may be performed in the tub 20 using mixed water in which the detergent and wash water are mixed. Thereafter, for example, in a final rinsing mode of the washing machine, the processor 300 may operate the detergent pump 120 such that the detergent contained in the second detergent case 112 to flow to the mixing space 222*a* through the detergent pump 120. Thereby, the rinsing mode may be performed using the mixed water in which the detergent is mixed with wash water. In this case, the detergent contained in the first detergent case 111 may be a laundry detergent, and the detergent contained in the second detergent case 112 may be a fabric softener.

The embodiments of the present disclosure have been shown and described above with reference to the accompanying drawings. However, the disclosed embodiments are illustrative and the scope of the present disclosure is not limited thereby. It will be understood by those of ordinary skill in the art that the present disclosure may be easily modified into other detailed forms without changing the technical principle or essential features of the present disclosure.

What is claimed is:

1. A clothes treating apparatus comprising:

a cabinet;

a tub in the cabinet and configured to collect wash water;

a circulation device configured to circulate the wash water contained in the tub, and the circulation device comprising:

a circulation pump;

a first circulation path to guide the wash water from the tub to the circulation pump; and a second circulation path to guide the wash water from the circulation pump to the tub so that the wash water circulates by flowing from the tub to the circulation pump through the first circulation path and flowing back to the tub from the circulation pump through the second circulation path; and a detergent supply device configured to supply a detergent to the circulation device, the detergent supply device comprising:

a detergent case to store the detergent; and a detergent pump connected to the detergent case and directly mounted on the first circulation path to supply the stored detergent from the detergent case to the first circulation path, the detergent pump including:

an inlet through which the detergent is introduced from the detergent case; and an outlet through which the introduced detergent is discharged, wherein the first circulation path comprises a mixing path mounted with the detergent pump, the mixing path including an inlet which is directly connected to the outlet of the detergent pump to receive the detergent from the detergent case thereby mixing the detergent with the wash water flowing in the first circulation path.

2. The clothes treating apparatus according to claim 1, wherein the first circulation path further comprises:

a drain path to guide the wash water discharged from the tub therethrough.

3. The clothes treating apparatus according to claim 2, wherein the drain path comprises:

a first drain path to guide the wash water from the tub out of the tub therethrough; and a second drain path connected to the first drain path and branching from the first drain path.

4. The clothes treating apparatus according to claim 3, further comprising a drain pump configured to receive the wash water from the first drain path and mounted on the second drain path.

5. The clothes treating apparatus according to claim 4, further comprising a water supply device configured to supply the wash water into the tub from an external water supply source, wherein the wash water flowing into the tub by the water supply device flows to the tub after passing through the first circulation path, the circulation pump, and the second circulation path in response to the circulating of the wash water by the circulation pump.

6. The clothes treating apparatus according to claim 5, further comprising a processor configured to selectively operate the circulation pump or the drain pump.

7. The clothes treating apparatus according to claim 6, wherein the processor is further configured to operate the circulation pump in response to determining that a water level in the tub reaches a predetermined water level.

8. The clothes treating apparatus according to claim 7, wherein the processor is further configured to operate the detergent pump in response to the operating of the circulation pump.

9. The clothes treating apparatus according to claim 8, wherein the detergent case comprises:

a first detergent case; and a second detergent case separated from the first detergent case in a lateral direction, wherein the processor is further configured:

to operate the circulation pump based on an initiation of a washing operation;

to operate the detergent pump to allow a detergent contained in the first detergent case to flow into the detergent pump based on the operation of the circulation pump; and to operate the detergent pump to allow a detergent contained in the second detergent case to flow into the detergent pump based on an initiation of a rinsing mode.

10. The clothes treating apparatus according to claim 6, wherein the processor is further configured to turn off the circulation pump and turn on the drain pump to drain the wash water contained in the tub.

11. The clothes treating apparatus according to claim 5, wherein the detergent supply device and the circulation device are disposed below the tub.

12. The clothes treating apparatus according to claim 11, wherein the detergent supply device is a first detergent supply device, and the clothes treating apparatus further comprises a second detergent supply device disposed above the tub to supply the detergent into the tub.

13. The clothes treating apparatus according to claim 12, further comprising:

a fan above the tub to form a circulating air flow passing through the tub; and a heat exchanger above the tub to dehumidify and heat air discharged from the tub and supply the dehumidified and heated air to the tub.

14. The clothes treating apparatus according to claim 1, wherein the detergent supply device further comprises a drawer configured to accommodate the detergent case and to be withdrawn from or inserted into the cabinet.

15. The clothes treating apparatus according to claim 14, wherein the drawer comprises:

a first drawer configured to accommodate the detergent case and withdrawn from or inserted into the cabinet; and a second drawer coupled to a side wall of the cabinet, configured to accommodate the first drawer, and slidably coupled to the first drawer allowing the first drawer to slide.

16. The clothes treating apparatus of claim 1, wherein the mixing path comprises a mixing space formed therein to receive the wash water from the tub and the discharged detergent through the inlet of the mixing path which is directly connected to the outlet of the detergent pump.

17. The clothes treating apparatus of claim 16, wherein the supplied wash water from an external water supply source flows back to the tub after passing through the water supply device, the tub, and the mixing space.

18. A clothes treating apparatus comprising:

a cabinet;

a tub in the cabinet and configured to collect wash water;

a detergent supply device configured to supply a detergent into the tub, the detergent supply device including:

a detergent case to accommodate the detergent;

a detergent pump including:

an inlet through which the detergent is introduced from the detergent case; and an outlet through which the introduced detergent is discharged; and a mixing space formed therein to receive the wash water from the tub and directly connected to the outlet of the detergent pump to receive the discharged detergent from the detergent pump;

a drain pump connected to the tub to drain the wash water contained in the tub out of the cabinet;

a circulation pump connected to the tub to circulate the wash water;

a first circulation path to guide the wash water from the tub to the circulation pump;

a second circulation path to guide the wash water from the circulation pump to the tub so that the wash water circulates by flowing from the tub to the circulation pump through the first circulation path and flowing back to the tub from the circulation pump through the second circulation path; and a processor configured to selectively operate the drain pump or the circulation pump, wherein the first circulation path includes a mixing path on which the outlet of the detergent pump is mounted and having a mixing space formed therein to receive the wash water from the tub and directly connected to the outlet of the detergent pump to receive the discharged detergent from the detergent pump.

19. The clothes treating apparatus of claim 18, wherein the processor is further configured to operate the detergent pump in response to the operating of the circulation pump.

20. The clothes treating apparatus of claim 19, wherein the processor is further configured to turn off the circulation pump and turn on the drain pump to drain the wash water contained in the tub.

* * * * *